US005338628A

United States Patent [19]

Kato et al.

[11] Patent Number: 5,338,628

[45] Date of Patent: Aug. 16, 1994

[54] ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 945,717

[22] Filed: Sep. 15, 1992

[30] Foreign Application Priority Data

Sep. 17, 1991 [JP] Japan ..... 3-262508
Nov. 27, 1991 [JP] Japan ..... 3-335810

[51] Int. Cl.[5] ..... G03G 15/08
[52] U.S. Cl. ..... 430/95; 430/96
[58] Field of Search ..... 430/96, 95, 84

[56] References Cited

U.S. PATENT DOCUMENTS 5,227,272 7/1993 Kato ..... 430/96

*Primary Examiner*—Steve Rosasco
*Attorney, Agent, or Firm*—Sughrue, Mion, Zinn, Macpeak & Seas

[57] ABSTRACT

An electrophotographic light-sensitive material comprising a support having provided thereon at least one photoconductive layer containing an inorganic photoconductive substance, a spectral sensitizing dye and a binder resin, wherein the binder resin comprises at least one resin (A) and at least one resin (B) as described in the specification.

12 Claims, No Drawings

ELECTROPHOTOGRAPHIC LIGHT-SENSITIVE MATERIAL

FIELD OF THE INVENTION

The present invention relates to an electro-photographic light-sensitive material, and more particularly to an electrophotographic light-sensitive material which is excellent in electrostatic characteristics and moisture resistance.

BACKGROUND OF THE INVENTION

An electrophotographic light-sensitive material may have various structures depending upon the characteristics required or an electrophotographic process to be employed.

Typical electrophotographic light-sensitive materials widely employed comprise a support having provided thereon at least one photoconductive layer and, if necessary, an insulating layer on the surface there-of. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced. In particular, a direct electrophotographic lithographic plate has recently become important as a system for printing in the order of from several hundreds to several thousands prints having a high image quality.

Under these circumstances, binder resins which are used for forming the photoconductive layer of an electrophotographic light-sensitive material are required to be excellent in the film-forming properties by themselves and the capability of dispersing photoconductive powder therein. Also, the photoconductive layer formed using the binder resin is required to have satisfactory adhesion to a base material or support. Further, the photoconductive layer formed by using the binder resin is required to have various excellent electrostatic characteristics such as high charging capacity, small dark decay, large light decay, and less fatigue due to prior light-exposure and also have an excellent image forming properties, and the photoconductive layer stably maintains these electrostatic properties in spite of the fluctuation in humidity at the time of image formation.

Further, extensive studies have been made for lithographic printing plate precursors using an electro photographic light-sensitive material, and for such a purpose, binder resins for a photoconductive layer which satisfy both the electrostatic characteristics as an electrophotographic light-sensitive material and printing properties as a printing plate precursor are required.

It has been found that the chemical structure of binder resin used in a photoconductive layer which contains at least an inorganic photoconductive substance, a spectral sensitizing dye and a binder resin has a great influence upon the electrostatic characteristics as well as smoothness of the photoconductive layer. Among the electrostatic characteristics, dark charge retention rate (D.R.R.) and photosensitivity are particularly affected.

Various investigations have been made on techniques for improvements in the smoothness and electrostatic characteristics of the photoconductive layer by using, as a binder resin, a resin having a relatively low molecular weight (i.e., a weight average molecular weight of from $10^3$ to $10^4$) and containing an acidic group. For instance, JP-A-63-217354 (the term "JP-A" as used herein means an "unexamined published Japanese Patent Application") discloses a resin having a polymer component containing an acidic group at random in the polymer main chain, U.S. Pat. No. 4,968,572 discloses a resin having an acidic group bonded at one terminal of the polymer main chain, U.S. Pat. Nos. 5,021,311 and 5,063,130, and EP-A-0389928 disclose a resin of graft type copolymer having an acidic group bonded at the terminal of the polymer main chain and a resin of graft type copolymer containing an acidic group in the graft portion, and EP-A-0432727 discloses an AB block copolymer containing an acidic group as a block.

It is presumed that these low molecular weight resins can act for sufficiently dispersing the photoconductive substance to restrain the occurrence of aggregation of photoconductive substance, and the acidic group thereof is sufficiently adsorbed on the stoichiometric defect of the inorganic photoconductive substance without hindering the adsorption of spectral sensitizing dye on the photoconductive substance and the resins mildly but sufficiently cover the surface of photoconductive substance. Also, it is presumed that even when the stoichiometric defect of the inorganic photoconductive substance varies to some extents, a relatively stable interaction between the inorganic photoconductive substance, spectral sensitizing dye and resin may be maintained since the resin has the sufficient adsorptive domain by the function and mechanism as described above. Of these resins, the graft type copolymer and AB block copolymer can provide a relatively stable performance even when ambient conditions are fluctuated.

Further, in order to obtain a satisfactorily high mechanical strength of the photoconductive layer which may be insufficient by only using the low molecular weight resin, various investigations have been made on techniques wherein a medium to high molecular weight resin is used together with the low molecular weight resin or wherein a resin containing a curable group is employed together with the low molecular weight resin and the layer containing these resins is cured after coating as described, for example, in U.S. Pat. Nos. 4,871,638, 63-220149, 63-220148, 4,968,572, 1-211766, 4,952,475, 5,084,367, 5,030,534, 5,009,975, 5,073,467, 5,077,166, 5,104,760, 5,104,759, 5,124,221, 3-92861, 3-92862, EP-A-0410324 and EP-A-0440226.

However, it has been found that, even in a case of using these various low molecular weight resins having an acidic group or in a case of using these low molecular weight resins together with medium to high molecular weight resins, it is yet insufficient to keep the stable performance in the case of greatly changing the ambient conditions from high-temperature and high-humidity to low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

Further, when the scanning exposure system using a semiconductor laser beam is applied to hitherto known light-sensitive materials for electrophotographic lithographic printing plate precursors, various problems may occur in that the difference between $E_{\frac{1}{2}}$ and $E_{1/10}$ is particularly large and the contrast of the duplicated image is decreased. Moreover, it is difficult to reduce the remaining potential after exposure, which results in severe fog formation in duplicated image, and when employed as offset masters, edge marks of originals pasted up appear on the prints, in addition to the insufficient electrostatic characteristics described above.

Moreover, it has been desired to develop a technique which can faithfully reproduce highly accurate images of continuous gradation as well as images composed of lines and dots using a liquid developer. However, the above-described known techniques are still insufficient to fulfill such a requirement. Specifically, in the known technique, the improved electrostatic characteristics which are achieved by means of the low molecular weight resin may be sometimes deteriorated by using it together with a medium to high molecular weight resin. In fact, it has been found that an electrophotographic light-sensitive material having a photoconductive layer wherein the above described known resins are used in combination may cause a problem on reproducibility of the above described highly accurate image (particularly, an image of continuous gradation) or on image forming performance in case of using a scanning exposure system with a laser beam of low power.

SUMMARY OF THE INVENTION

The present invention has been made for solving the problems of conventional electrophotographic light-sensitive materials as described above and meeting the requirement for the light-sensitive materials.

An object of the present invention is to provide an electrophotographic light-sensitive material having stable and excellent electrostatic characteristics and giving clear good images even when the ambient conditions during the formation of duplicated images are fluctuated to low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semi-conductor laser beam.

A still further object of the present invention is to provide an electrophotographic lithographic printing plate precursor having excellent electrostatic characteristics (in particular, dark charge retention characteristics and photosensitivity), capable of reproducing a faithful duplicated image to the original (in particular, a highly accurate image of continuous gradation), forming neither overall background stains nor dotted background stains of prints, and showing excellent printing durability.

Other objects of the present invention will become apparent from the following description and examples.

It has been found that the above described objects of the present invention are accomplished by an electrophotographic light-sensitive material comprising a support having provided thereon at least one photoconductive layer containing an inorganic photoconductive substance, a spectral sensitizing dye and a binder resin, wherein the binder resin comprises at least one resin (A) shown below and at least one resin (B) shown below.

Resin (A)

A starlike copolymer having a weight average molecular weight of from $1\times10^3$ to $2\times10^4$ and comprising an organic molecule having bonded thereto at least three polymer chains each containing a polymer component (a) corresponding to a repeating unit represented by the following general formula (I):

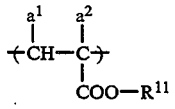

(I)

(wherein $a^1$ and $a^2$ each represents a hydrogen atom, a halogen atom, a cyano group or a hydrocarbon group; and $R^{11}$ represents a hydrocarbon group) and a polymer component (b) containing at least one polar group selected from $-PO_3H_2$, $-SO_3H$, $-COOH$,

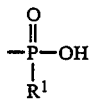

(wherein $R^1$ represents a hydrocarbon group or $-OR^2$ (wherein $R^2$ represents a hydrocarbon group)) and a cyclic acid anhydride-containing group, wherein the content of the polymer component (a) is not less than 30% by weight and the content of the polymer component (b) is from 1 to 20% by weight,

Resin (B)

A resin having a weight average molecular weight of from $3\times10^4$ to $1\times10^6$ and containing not less than 30% by weight of a polymer component corresponding to a repeating unit represented by the following general formula (III):

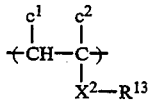

(III)

wherein $c^1$ and $c^2$ each represents a hydrogen atom, a halogen atom, a cyano group or a hydrocarbon group; $X^2$ represents $-(CH_2)_rCOO-$, $-(CH_2)_rOCO-$, $-O-$ or $-CO-$ (wherein r represents an integer of from 0 to 3); and $R^{13}$ represents a hydrocarbon group.

DETAILED DESCRIPTION OF THE INVENTION

The binder resin which can be used in the present invention comprises at least a low molecular weight starlike copolymer comprising an organic molecule having bonded thereto at least three polymer chains containing a polymer component represented by the general formula (I) described above and a polymer component containing the specified polar group described above (resin (A)) and a high molecular weight polymer containing not less than 30% by weight of a polymer component represented by the general formula (III) described above (resin (B)).

As described above, the resin having an acidic group-containing polymer component at random in the polymer main chain, resin having an acidic group bonded at only one terminal of the polymer main chain, graft type copolymer having an acidic group in the graft portion or at the terminal of the polymer main chain and AB block copolymer containing an acidic group as a block are illustrated as a low molecular weight binder resin containing an acidic group known for improving the smoothness and electrostatic characteristics of the photoconductive layer. On the contrary, the low molecular weight resin (A) according to the present invention is a starlike copolymer having the specified chemical structure of polymer wherein at least three polymer chains having the polar group-containing polymer component are bonded to an organic molecule. Therefore, the resin (A) is clearly different from the known resins in its bonding pattern of polymer chains.

It is presumed that, in the resin (A) used in the present invention, the polar group-containing components present in the polymer chains are sufficiently adsorbed on the stoichiometric defect of the inorganic photoconductive substance and other components (e.g., those represented by the general formula (I)) constituting the polymer main chain mildly but sufficiently cover the surface of the inorganic photoconductive substance. Also, it is presumed that, even when the stoichiometric defect portion of the inorganic photoconductive substance varies to some extents, the stable interaction of the inorganic photoconductive substance with the resin (A) used in the present invention is always maintained since the resin (A) has the sufficient adsorptive domain and effectively provides the sufficient adsorption on the surface of inorganic photoconductive substance and the coverage in the neighborhood of the surface as compared with the known resins. More specifically, the resin (A) according to the present invention has the important functions in that particles of the inorganic photoconductive substance are sufficiently dispersed by the resin (A) to prevent the occurrence of aggregation of the particles of the photoconductive substance and also the spectral sensitizing dye sufficiently adsorbed on the surface of the inorganic photoconductive substance, in that the binder resin is adsorbed sufficiently to excessive active sites on the surface of the inorganic photoconductive substance and the traps thereof are compensated, in that the binder resin is sufficiently adsorbed on particles of the inorganic photoconductive substance to disperse uniformly these particles and the aggregation thereof is prevented due to its short polymer chain, and in that adsorption of the spectral sensitizing dye on the inorganic photoconductive substance does not disturbed. Thus, it has been found that, according to the present invention, the traps of the inorganic photoconductive substance are more effectively and sufficiently compensated and the humidity characteristics of the photoconductive substance are improved as well as sufficient dispersion of the inorganic photoconductive substance and restrain of the occurrence of aggregation are achieved as compared with conventionally known polar group-containing low molecular weight resins.

Moreover, it has been found that, when the low molecular weight starlike copolymer containing a polar group (resin (A)) is employed together with the medium to high molecular weight resin containing not more than 30% by weight of a polymer component represented by the general formula (III) (resin (B)), the mechanical strength of the photoconductive layer is sufficiently increased without damaging the excellent electrophotographic characteristics attained by the use of the resin (A).

It has become apparent that an appropriate action of the medium to high molecular weight resin (B) on the interaction of the inorganic photoconductive substance, spectral sensitizing dye and low molecular weight resin (A) in the photoconductive layer is an unexpectedly important factor. It has been also found to be preferred that the resin (B) which is used together with the resin (A) further has at least one polar group selected from $-PO_3H_2$, $-SO_3H$, $-COOH$,

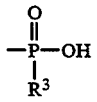

(wherein $R^3$ has the same meaning as $R^1$ defined above) and a cyclic acid anhydride-containing group bonded at the terminal of the polymer main chain. This type of resin (B) is sometimes referred to as resin (B') hereinafter.

It is presumed that, as a result of synergistic effect of the resin (A) and resin (B) according to the present invention, particles of inorganic photoconductive substance are sufficiently dispersed without the occurrence of aggregation, the spectral sensitizing dye is sufficiently adsorbed on the surface of particles of inorganic photoconductive substance, and the binder resin is sufficiently adsorbed to excessive active sites on the surface of the inorganic photoconductive substance to compensate the traps. More specifically, the low molecular weight resin (A) containing the specific polar group has the important function in that the binder resin is sufficiently adsorbed on the surface of particles of the inorganic photoconductive substance to disperse uniformly and to restrain the occurrence of aggregation due to its short polymer chain and in that adsorption of the spectral sensitizing dye on the inorganic photoconductive substance is not disturbed. The medium to high molecular weight resin (B') having the specific polar group bonded at the terminal of the polymer main chain acts further thereto preferably and effects on maintaining the sufficient mechanical strength of the photoconductive layer. This is believed to be based on that the polar group of the resin (B') which has a higher molecular weight has a weak interaction with the particles of photoconductive substance compared with the resin (A) and that the remaining polymer chains of the resins (B') intertwine each other. This effect is particularly remarkable in polymethine dyes or phthalocyanine series pigments which are particularly effective as spectral sensitizing dyes for the region of near infrared to infrared light.

When the electrophotographic light-sensitive material according to the present invention containing photoconductive zinc oxide as the inorganic photoconductive substance is applied to a conventional direct printing plate precursor, extremely good water retentivity as well as the excellent image forming performance can be obtained. More specifically, when the light-sensitive material according to the present invention is subjected to an electrophotographic process to form an duplicated image, oil-desensitization of non-image portions by chemical treatment with a conventional oil-desensitizing solution to prepare a printing plate, and printing by an offset printing system, it exhibits excellent characteristics as a printing plate.

When the electrophotographic light-sensitive material according to the present invention is subjected to the oil-desensitizing treatment, the non-image portions are rendered sufficiently hydrophilic to increase water retentivity which results in remarkable increase in a number of prints obtained. It is believed that these results are obtained by the fact that zinc oxide particles are uniformly dispersed and the state of binder resin present on the surface of zinc oxide particles is proper to conduct an oil-desensitizing reaction with the oil-desensitizing solution rapidly and effectively.

According to a preferred embodiment of the present invention, the resin (A) is a resin (hereinafter sometimes referred to as resin (A')) containing a polar group-containing component and a methacrylate component having a specific substituent containing a benzene ring which has a specific substituent(s) at the 2-position or 2- and 6-positions thereof or a specific substituent containing an unsubstituted naphthalene ring represented by the following general formula (Ia) or (Ib):

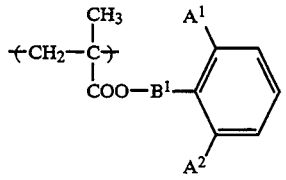
(Ia)

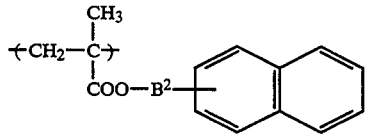
(Ib)

wherein $A^1$ and $A^2$ each represents a hydrogen atom, a hydrocarbon group having from 1 to 10 carbon atoms, a chlorine atom, a bromine atom —$COR^{14}$ or —$COOR^{14}$ wherein $R^{14}$ represents a hydrocarbon group having from 1 to 10 carbon atoms; and $B^1$ and $B^2$ each represents a mere bond or a linking group containing from 1 to 4 linking atoms, which connects —COO— and the benzene ring.

In case of using the resin (A'), the electro-photographic characteristics, particularly, $V_{10}$, D.R.R. and $E_{1/10}$ of the electrophotographic material can be furthermore improved as compared with the use of the resin (A). While the reason for this fact is not fully clear, it is believed that the polymer molecular chain of the resin (A') is suitably arranged on the surface of inorganic photoconductive substance such as zinc oxide in the layer depending on the plane effect of the benzene ring having a substituent at the ortho position or the naphthalene ring which is an ester component of the methacrylate whereby the above described improvement is achieved.

The binder resin according to the present invention will be described in more detail below.

Now, the resin (A) will be described in detail below.

The resin (A) is a so-called starlike copolymer comprising an organic molecule having bonded thereto at least three polymer chains containing a polymer component (a) represented by the general formula (I) and a polymer component (b) containing the specific polar group. For instance, the copolymer can be schematically illustrated below.

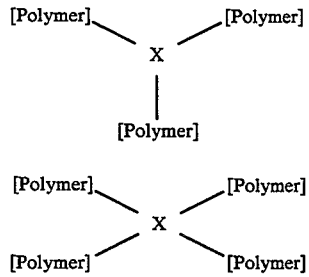

wherein X represents an organic molecule; and [Polymer] represents a polymer chain.

Three or more polymer chains which are bonded to the organic molecule may be the same as or different from each other and each contains at least the polymer component represented by the general formula (I) and the polar group-containing polymer component. The length of each polymer chain may be the same or different. A number of the polymer chains bonded to an organic molecule is at most 15, and usually about 10 or less.

The weight average molecular weight of the resin (A) is from $1\times10^3$ to $2\times10^4$, and preferably from $3\times10^3$ to $1\times10^4$. The glass transition point of the resin (A) is preferably from −40° C. to 110° C., and more preferably from −20° C. to 90° C.

If the weight average molecular weight of the resin (A) is less than $1\times10^3$, the film-forming property of the resin is lowered, thereby a sufficient film strength cannot be maintained, while if the weight average molecular weight of the resin (A) is higher than $2\times10^4$, the effect of the present invention for obtaining stable duplicated images is reduced since fluctuations of the electrophotographic characteristics (particularly, initial potential, dark decay retention rate and photosensitivity) of the photoconductive layer, in particular, that containing a spectral sensitizing dye for sensitization in the range of from near-infrared to infrared become somewhat large under severe conditions of high temperature and high humidity or low temperature and low humidity.

The resin (A) used in the present invention has a structure of a starlike copolymer as described above, and the content of the polar group-containing polymer component (b) present in the polymer chains of the resin (A) is from 1 to 20 parts by weight, preferably from 3 to 15 parts by weight per 100 parts by weight of the resin (A).

If the content of the polar group-containing component in the resin (A) is less than 1% by weight, the initial potential is low and thus satisfactory image density can not be obtained. On the other hand, if the content of the polar group-containing component is larger than 20% by weight, various undesirable problems may occur, for example, the dispersibility is reduced, and further when the light-sensitive material is used as an offset master plate, the occurrence of background stains may increase. Two or more kinds of the polymer components containing the specific polar group may be present in the polymer chains.

The content of the polymer component corresponding to the repeating unit represented by the general formula (I) present in the polymer chains of the resin (A) is not less than 30 parts by weight, preferably from 30 to 99 parts by weight, more preferably from 50 to 99 parts by weight per 100 parts of the resin (A).

The polymer components constituting the polymer chains of the starlike copolymer (resin (A)) .of the present invention will be described in detail below.

In the repeating unit represented by the general formula (I), $a^1$ and $a^2$ each represents a hydrogen atom, a halogen atom (e.g., fluorine, chlorine, and bromine), a cyano group or a hydrocarbon group (including, for example, an aliphatic group having from 1 to 8 carbon atoms (e.g., methyl, ethyl, propyl, butyl, pentyl, hexyl, and benzyl), and an aromatic group having from 6 to 12 carbon atoms (e.g., phenyl)). Preferably $a^1$represents a hydrogen atom and $a^2$ represents a methyl group.

$R^{11}$ in the general formula (I) represents a hydrocarbon group including an alkyl group, an aralkyl group and an aromatic group, and is preferably a hydrocarbon group containing a benzene ring or naphthalene ring including an aralkyl group and an aromatic group.

More specifically, $R^{11}$ is preferably a hydrocarbon group having from 1 to 18 carbon atoms, which may be substituted. Suitable examples of the substituent include a halogen atom (e.g., fluorine, chlorine, and bromine) and —O—$Z^1$, —COO—$Z^1$, and —OCO—$Z^1$ (wherein $Z^1$represents an alkyl group having from 1 to 22 carbon atoms, e.g., methyl, ethyl, propyl, butyl, hexyl, octyl, decyl, dodecyl, hexadecyl, and octadecyl). Preferred examples of the hydrocarbon group include an alkyl group having from 1 to 18 carbon atoms which may be substituted (e.g., methyl, ethyl, propyl, butyl, pentyl, hexyl, heptyl, octyl, decyl, dodecyl, hexadecyl, octadecyl, 2-chloroethyl, 2-bromoethyl, 2-cyanoethyl, 2methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

Of the repeating units represented by the general formula (I), those represented by the general formula (Ia) or (Ib) are preferred as described above.

In the general formula (Ia), $A^1$ and $A^2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl) —$COZ^2$ or —$COOZ^2$, wherein $Z^2$ preferably represents any of the above-recited hydrocarbon groups for $A^1$ or $A^2$.

In the general formulae (Ia) and (Ib), $B^1$ and $B^2$each represents a mere bond or a linking group containing from 1 to 4 linking atoms which connects between —COO—and the benzene ring, e.g., $$\leftarrow CH_2 \rightarrow_a$$

(wherein a represents an integer of 1, 2 or 3), —$CH_2OCO$—, —$CH_2CH_2OCO$—, $$\leftarrow CH_2O \rightarrow_b$$

(wherein b represents an integer of 1 or 2), and —$CH_2CH_2O$—, and preferably represents a mere bond or a linking group containing from 1 to 2 linking atoms.

Specific examples of the repeating units represented by the general formula (Ia) or (Ib) which are preferably used in the resin (A) according to the present invention are set forth below, but the present invention is not to be construed as being limited thereto. In the following formulae (a-1) to (a-20), c represents an integer of from 1 to 4; d represents an integer of from 0 to 3; e represents an integer of from 1 to 3; $R^6$ represents —$C_cH_{2+1}$ or

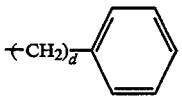

(wherein c and d each has the same meaning as defined above); and $D^1$ and $D^2$, which may be the same or different, each represents a hydrogen atom, —Cl, —Br or —I.

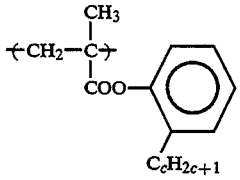
(a-1)

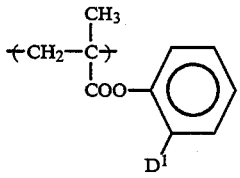
(a-2)

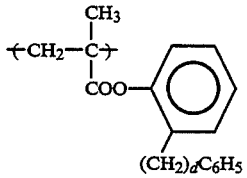
(a-3)

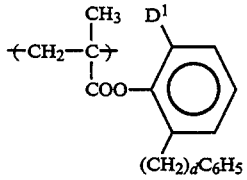
(a-4)

-continued (a-5)

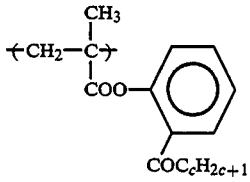

(a-6)

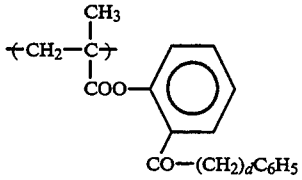

(a-7)

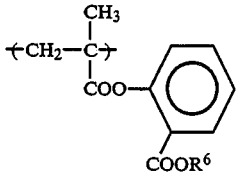

(a-8)

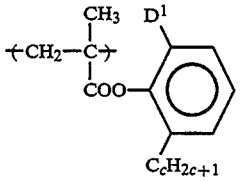

(a-9)

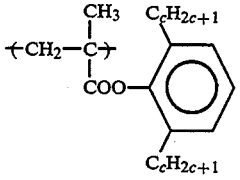

(a-10)

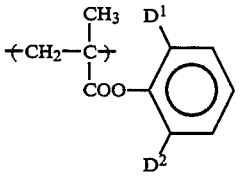

(a-11)

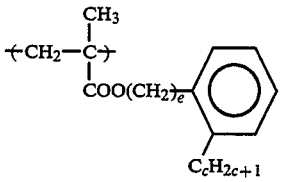

(a-12)

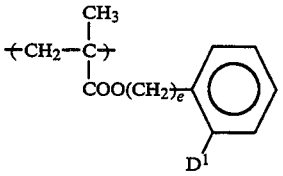

(a-13)

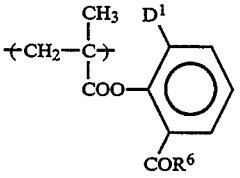

-continued (a-14)

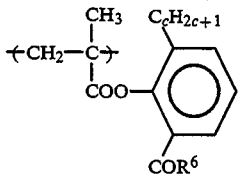

(a-15)

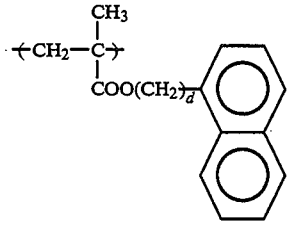

(a-16)

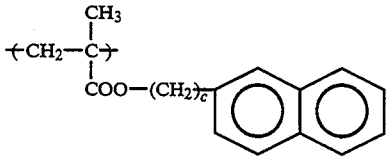

(a-17)

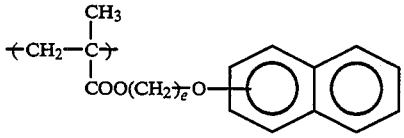

(a-18)

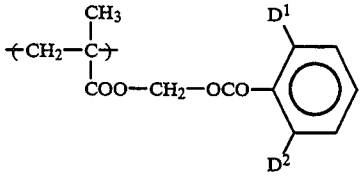

(a-19)

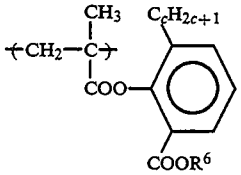

(a-20)

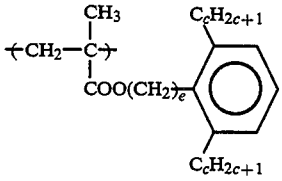

Now, the polymer component containing the specific polar group, which constitutes the polymer chains of the resin (A) used in the present invention will be explained in more detail below.

The polar group of the present invention includes —$PO_3H_2$, —$SO_3H$, —COOH,

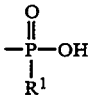

($R^1$ represents a hydrocarbon group or —$OR^2$ (wherein $R^2$ represents a hydrocarbon group)), and a cyclic acidic anhydride-containing group.

In the

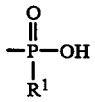

group, $R^1$ represents a hydrocarbon group or a $—OR^2$ group (wherein $R^2$ represents a hydrocarbon group), and, preferably, $R^1$ and $R^2$ each represents a hydrocarbon group having from 1 to 6 carbon atoms which may be substituted ( e.g., methyl, ethyl, propyl, butyl, 2-chloroethyl, 2-bromoethyl, 2-fluoroethyl, 3-chloropropyl, 3-methoxypropyl, 2-methoxybutyl, benzyl, phenyl, propenyl, methoxymethyl, ethoxymethyl, and 2-ethoxyethyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclo-pentane-1,2-dicarboxylic acid anhydride ring, cyclo-hexane-1,2-dicarboxylic acid anhydride ring, cyclo-hexene-1,2-dicarboxylic acid anhydride ring, and 2,3bicyclo[2,2,-2-octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

The above-described polymer component containing the specific polar group used in the resin (A) may be any vinyl compounds each having the polar group and being capable of copolymerizing with a monomer corresponding to the repeating unit represented by the general formula (I) (including the general formulae (Ia) and (Ib)).

For example, such vinyl compounds are described in *Macromolecular Data Handbook (Foundation)*, edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the acidic group in the substituent thereof.

Specific examples of the polymer components containing the specific polar group are set forth below, but the present invention should not be construed as being limited thereto. In the following formulae, $d^1$represents —H or $—CH_3$; $d^2$ represents —H, $—CH_3$ or $—CH_2COOCH_3$; $R^{11}$ represents an alkyl group having from 1 to 4 carbon atoms; $R^{12}$ represents an alkyl group having from 1 to 6 carbon atoms, a benzyl group or a phenyl group; f represents an integer of from 1 to 3; g represents an integer of from 2 to 11; h represents an integer of from 1 to 11; i represents an integer of from 2 to 4; and j represents an integer of from 2 to 10.

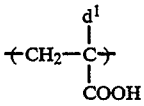
(b-1)

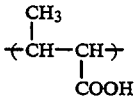
(b-2)

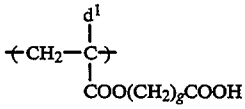
(b-3)

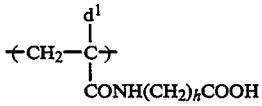
(b-4)

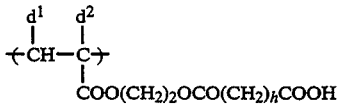
(b-5)

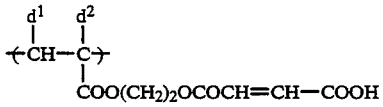
(b-6)

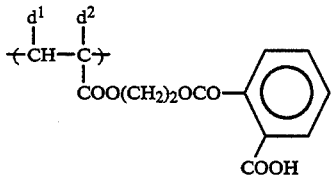
(b-7)

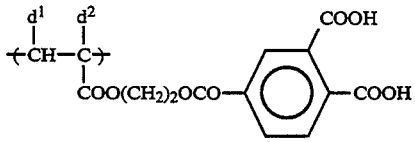
(b-8)

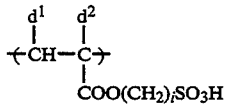
(b-9)

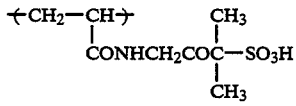
(b-10)

-continued
(b-11)
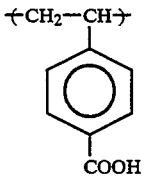
(b-12)
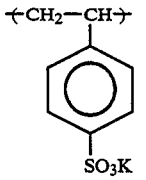
(b-13)
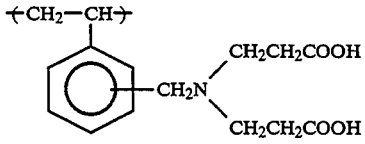
(b-14)
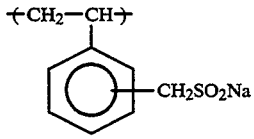
(b-15)
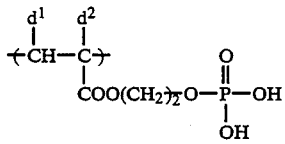
(b-16)
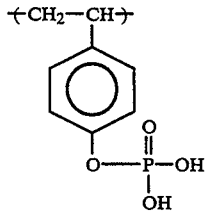
(b-17)
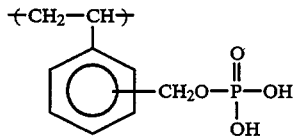
(b-18)
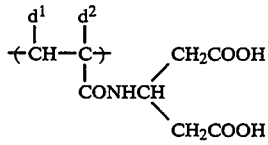
(b-19)
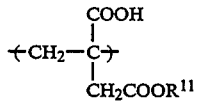
(b-20)
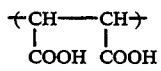
-continued
(b-21)
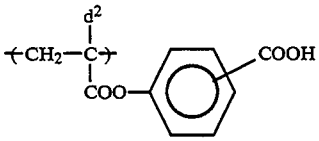
(b-22)
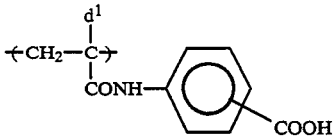
(b-23)
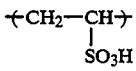
(b-24)
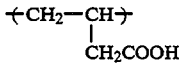
(b-25)
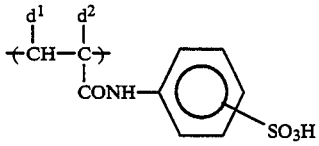
(b-26)
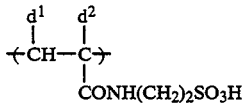
(b-27)
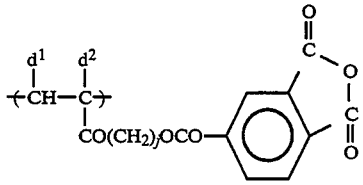
(b-28)
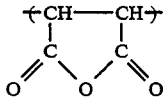
(b-29)
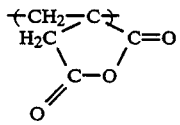
(b-30)
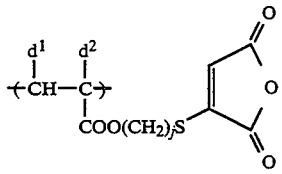
(b-31)
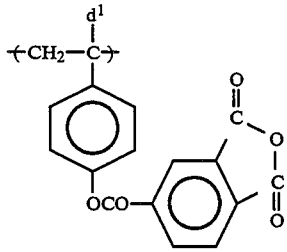

-continued
(b-32)
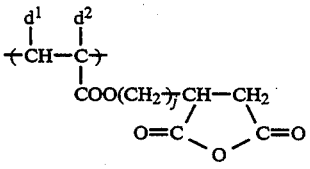
(b-33)
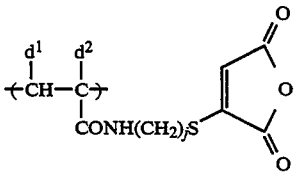
(b-34)
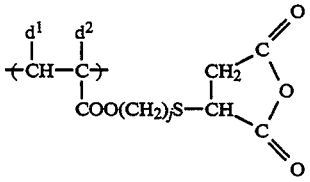
(b-35)
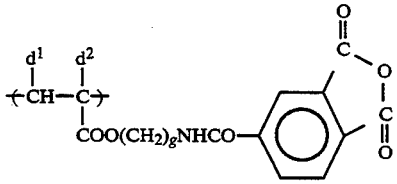
(b-36)
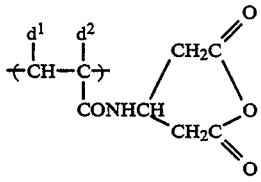
(b-37)
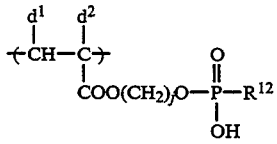
(b-38)
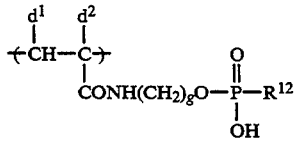
(b-39)
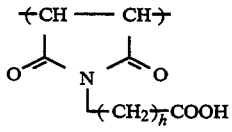
(b-40)
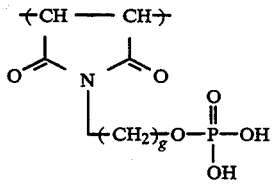
(b-41)
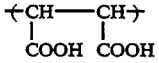
-continued
(b-42)
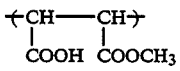
(b-43)
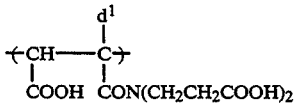
(b-44)
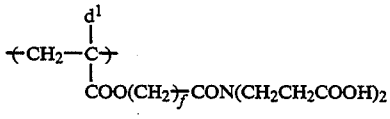
(b-45)
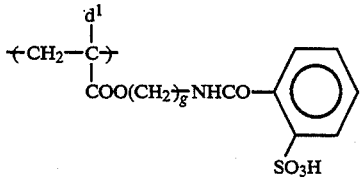
(b-46)
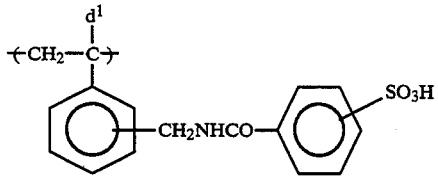
(b-47)
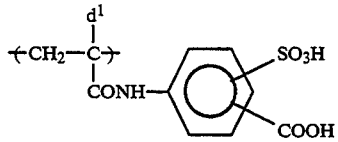
(b-48)
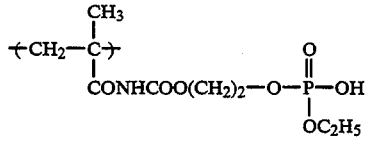
(b-49)
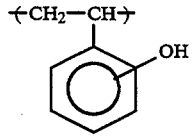
(b-50)
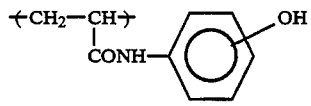
(b-51)
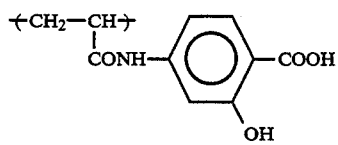
(b-52)
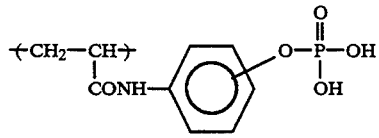
Two or more kinds of the polymer components containing the specific polar group may be employed in the polymer chain of the resin (A).

The polymer chain may contain other polymer components than the polar group-containing polymer components and the polymer components represented by the general formula (I).

Examples of such other polymer components include those corresponding to the repeating unit represented by the following general formula (II):

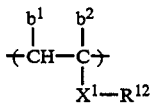

(II)

wherein $X^1$ represents $-COO-$, $-OCO-$, $\text{-}(CH_2)_p\text{-}OCO-$, $\text{-}(CH_2)_p\text{-}COO-$, $-O-$, $-SO_2-$, $-CO-$, $-CON(Z^3)-$, $-SO_2N(Z^3)-$, $-CONHCOO-$, $-CONHCONH-$ or

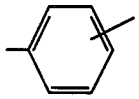

(wherein p represents an integer of from 1 to 3; and $Z^3$ represents a hydrogen atom or a hydrocarbon group); $R^{12}$ represents a hydrocarbon group; and $b^1$ and $b^2$ which may be the same or different, each has the same meaning as $a^1$ or $a^2$ in the general formula (I).

Preferred examples of the hydrocarbon group represented by $Z^3$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-l-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthyl-methyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, totyl, xylyl, propylphenyl, butylphenyl, octylphenyl, dodecytphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

When $X^1$ represents

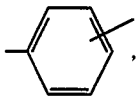

the benzene ring may be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

Preferred examples of the hydrocarbon group represented by $R^{12}$ include an alkyl group having from 1 to 22 carbon atoms which may be substituted (e.g., methyl, ethyl, propyl, butyl, pentyl, hexyl, heptyl octyl, decyl, dodecyl, tridecyl, tetradecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentyl-ethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

More preferably, in the general formula (II), $X^1$represents $-COO-$, $-OCO-$, $-CH_2OCO-$, $-CH_2COO-$, $-O-$, $-CONH-$, $-SO_2NH-$or

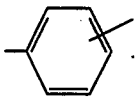

Moreover, the polymer chain may further contain other polymer components corresponding to monomers copolymerizable with monomers corresponding to the polymer components represented by the general formula (II). Examples of such monomers include, in addition to methacrylic acid esters, acrylic acid esters and crotonic acid esters containing substituents other than those described for the general formula (I), α-olefins, vinyl or allyl esters of carboxylic acids (including, e.g., acetic acid, propionic acid, butyric acid, and valeric acid, benzoic acid, naphthalenecarboxylic acid, as examples of the carboxylic acids), acrylonitrile, methacrylonitrile, vinyl ethers, itaconic acid esters (e.g., dimethyl ester, and diethyl ester), acrylamides, methacrylamides, styrenes (e.g., styrene, vinyltoluene, chlorostyrene, hydroxystyrene, N,N-dimethylaminomethyl-styrene, methoxycarbonylstyrene, methanesulfonyloxystyrene, and vinylnaphthalene), vinyl sulfone compounds, vinyl ketone compound, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine). However, such other monomers are preferably employed in an amount of not more than 20 parts by weight per 100 parts by weight of the total monomers constituting the polymer chain.

As described above, the polymer chain comprises at least one polymer component (b) containing the specific polar group and at least one polymer component (a) represented by the general formula (I), and .each of these components may be present at random or as a block.

In the latter case, the resin (A) is a starlike copolymer comprising an organic molecule having bonded thereto at least three AB block polymer chains each containing an A block comprising at least one polymer component (a) and a B block comprising at least one polymer component (b). The A block and the B block in the polymer chain can be arranged in any order. Such a type of the resin (A) can, for example, be schematically illustrated below.

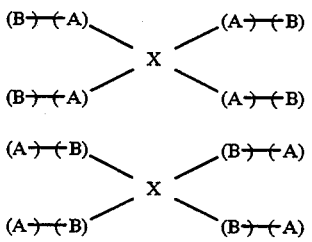

wherein X represents an organic molecule; (A) represents A block; (B) represents B block; and (A)-(B) represents a polymer chain.

The weight average molecular weight and the contents of polymer components (a) and (b) are the same as described above.

The content of the polymer component corresponding to the general formula (I) in the A block of the resin (A) is preferably from 30 to 100% by weight, more preferably from 50 to 100% by weight. The A block does not contain any specified polar group-containing polymer component used in the B block. The A block may contain the above described polymer components represented by the general formula (II) and, if desired, above described other polymer components corresponding to monomers copolymerizable with monomers corresponding to the polymer components represented by the general formula (II). However, such other polymer components are employed in an amount of not more than 20 parts by weight per 100 parts by weight of the total polymer components of the A block.

The B block in the polymer chain comprises the polymer component (b) containing the specific polar group as described above. The B block may contain two or more kinds of the polymer components each having the specific polar group, and in this case, two or more kinds of these polar group-containing components may be contained in the B block in the form of a random copolymer or a block copolymer. Further, the B block may contain the above described polymer components represented by the general formulae (I) and (II) and, if desired, above described other polymer components corresponding to monomers copolymerizable with monomers corresponding to the polymer components represented by the general formula (II). The content of the polymer component having the specific polar group in the B block is from 1 to 100% by weight.

The organic molecule to which at least three polymer chains are bonded and which is used in the resin (A) according to the present invention is any organic molecule having a molecular weight of 1000 or less. Suitable examples of the organic molecules include those containing a trivalent or more hydrocarbon moiety shown below.

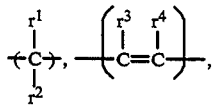

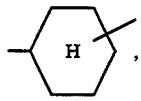

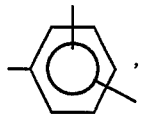

wherein ( ) represents a repeating unit; $r^1$, $r^2$, $r^3$ and $r^4$ each represents a hydrogen atom or a hydrocarbon group, provided that at least one of $r^1$ and $r^2$ or $r^3$ and $r^4$ is bonded to a polymer chain.

These organic moieties may be employed individually or as a combination thereof. In the latter case, the combination may further contain an appropriate linking unit, for example, —O—, —S—,

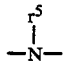

(wherein $r^5$ represents a hydrogen atom or a hydrocarbon group) ,

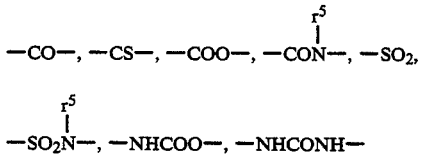

and a heterocyclic group containing at least one hetero atom such as oxygen, sulfur or nitrogen (e.g., thiophene, pyridine, pyran, imidazole, benzimidazole, furan, piperidine, pyrazine, pyrrole and piperazine, as the hetero ring).

Other examples of the organic molecules to which the polymer chains are bonded include those comprising a combination of

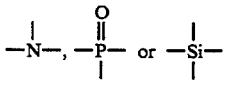

with a linking unit described above. However, the organic molecules which can be used in the present invention should not be construed as being limited to those described above.

The starlike copolymer according to the present invention can be prepared by utilizing conventionally known synthesis methods of starlike polymers using monomers containing a polar group and a polymerizable double bond group. For instance, a method of polymerization reaction using a carboanion as an initiator can be employed. Such a method is specifically described in M. Morton, T. E. Helminiak et al, *J. Polym. Sci.*, 57, 471 (1962), B. Gordon III, M. Blumenthal, J. E. Loftus, et al *Polym. Bull.*, 11, 349 (1984), and R. B. Bates, W. A. Beavers, et al, *J. Org. Chem.*, 44, 3800 (1979). In case of using the reaction, it is required that the specific polar group be protected to form a functional group and the protective group be removed after polymerization.

The protection of the specific polar group of the present invention and the release of the protective group (a reaction for removing a protective group) can be easily conducted by utilizing conventionally known knowledges. More specifically, they can be performed by appropriately selecting methods described, e.g., in Yoshio Iwakura and Keisuke Kurita, *Hannosei Kobunshi* (*Reactive Polymer*), Kodansha (1977), T. W. Greene, *Protective Groups in Organic Synthesis*, John Wiley & Sons (1981), and J. F. W. McOmie, *Protective Groups Organic Chemistry*, Plenum Press, (1973), as well as methods as described in the above references.

Further, the copolymer can be synthesized by conducting a polymerization reaction under light irradiation using a monomer having the unprotected polar group and also using a dithiocarbamate group-containing compound and/or a xanthate group-containing compound as an initiator. For example, the copolymer can be synthesized according to the synthesis methods described, e.g., in Takayuki Otsu, *Kobunshi* (*Polymer*), 37, 248 (1988), Shunichi Himori and Ryichi Otsu, *Polym. Rep. Jap.* 37, 3508 (1988), JP-A-64-111, JP-A-64-26619, Nobuyuki Higashi et al, *Polymer Preprints Japan*, 36 (6) 1511 (1987), and M. Niwa, N. Higashi et al, *J. Macromol. Sci. Chem.*, A24(5), 567 (1987).

The weight average molecular weight of the resin (A) can be easily controlled in the desired range by appropriately selecting the kinds of monomers and polymerization initiator, the amounts of these components, the polymerization temperature, etc., as conventionally known in a polymerization reaction.

Now, the resin (B) will be described in detail below.

The resin (B) used in the present invention contains at least one repeating unit represented by the general formula (III ) described above as a polymer component.

In the general formula (III ) , $c^1$ and $c^2$ have the same meanings as $a^1$ and $a^2$ defined in the general formula (I) described above.

$X^2$ represents $$\text{-}(CH_2)_r\text{-}COO\text{-},$$

$$\text{-}(CH_2)_r\text{-}OCO\text{-},$$

$$\text{-}O\text{-}, \text{ or } \text{-}\underset{\underset{O}{\|}}{C}\text{-}$$

(wherein r represents an integer of from 0 to 3). $X^2$ is preferably —COO—, —OCO—, —O—, —$CH_2COO$—, or —$CH_2OCO$—.

$R^{13}$ has the same meaning as $R^{11}$ defined in the general formula (I).

The resin (B) used in the present invention may contain a polymer component containing at least one kind of the polar groups selected from —COOH, —$PO_3H_2$, —$SO_3H$, $$\text{-}\overset{\overset{O}{\|}}{\underset{\underset{OH}{|}}{P}}\text{-}R^3$$

(wherein $R^3$ has the same meaning as $R^1$ defined above and a cyclic acid anhydride-containing group, in addition to the polymer component corresponding to the repeating unit represented by the general formula The polar group-containing copolymer component may be described from any monomer containing the specific polar group capable of copolymerizable with the monomer corresponding to the repeating unit represented by formula the general (III) and practically, the same compounds as the polar group-containing monomers which are used for the polymer chain of resin (A) as described above are used.

Furthermore, the polar group bonded .to one terminal of the polymer main chain in the resin (B') used in the present invention includes —$PO_3H_2$, —$SO_3H$, —COOH, $$\text{-}\overset{\overset{O}{\|}}{\underset{\underset{R^3}{|}}{P}}\text{-}OH,$$

and a cyclic acid anhydride-containing group as described above.

The above-described polar group may be bonded to the terminal of the polymer main chain either directly or via an appropriate linking group. Specific examples of suitable linking group include $$\text{-}\underset{\underset{p^2}{|}}{\overset{\overset{p^1}{|}}{C}}\text{-}$$

(wherein $p^1$ and $p^2$, which may be the same or different, each represents a hydrogen atom, a halogen atom (e.g., chlorine, and bromine), a hydroxyl group, a cyano group, an alkyl group (e.g., methyl, ethyl, 2-chloroethyl, 2-hydroxyethyl, propyl, butyl, and hexyl), an aralkyl group (e.g., benzyl, and phenethyl), an aryl group (e.g., phenyl), $$\text{-}\overset{p^1}{\overset{|}{C}}=\overset{p^2}{\overset{|}{C}}\text{-}$$

(wherein $p^1$ and $p^2$ each has the same meaning as defined above),

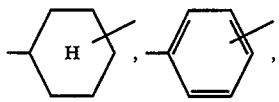

$$\text{-}O\text{-}, \text{-}S\text{-}, \text{-}\overset{p^3}{\overset{|}{N}}\text{-}$$

(wherein $p^3$ represents a hydrogen atom or a hydrocarbon group preferably having from 1 to 12 carbon atoms (e.g., methyl, ethyl, propyl, butyl, hexyl, octyl, decyl, dodecyl, 2-methoxyethyl, 2-chloroethyl, 2-cyanoethyl, benzyl, methylbenzyl, chlorobenzyl, methoxybenzyl, phenethyl, phenyl, tolyl, chlorophenyl, methoxy phenyl, and butylphenyl ) , —CO—, —COO—, —OCO—,

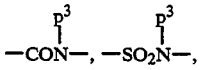

—$SO_2$—, —NHCONH—, —NHCOO—, —$NHSO_2$—, —CONHCOO—, —CONHCONH—, a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine, and morpholine)),

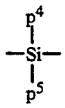

(wherein $p^4$ and $p^5$, which may be the same or different each represents a hydrocarbon group or —$Op^6$ (wherein $p^6$ represents a hydrocarbon group)), and a combination thereof. Suitable example of the hydrocarbon group represented by $p^4$, $p^5$ or $p^6$ include those described for $p^3$.

When the resin (B') further contains the specific polar group in the copolymer component constituting the main chain, the polar group contained in the copolymer component of the polymer may be the same as or different from the polar group bonded to the terminal of the polymer main chain.

Moreover, the resin (B) may contain a copolymer component having a heat- and/or photo-curable functional group. The content of the heat- and/or photo-curable functional group is preferably from 1 to 20% by weight.

The term "heat- and/or photo-curable functional group" as used herein means a functional group capable of inducing curing reaction of a resin on application of at least one of heat and light.

Specific examples of the photo-curable functional group include those used in conventional light-sensitive resins known as photocurable resins as described, for example, in Hideo Inui and Gentaro Nagamatsu, *Kankosei Kobunshi*, Kodansha (1977), Takahiro Tsunoda, *Shin*-Kankosei Jushi, Insatsu Gakkai Shuppanbu (1981), G. E. Green and B. P. Strak, *J. Macro. Sci. Reas. Macro. Chem.*, C 21 (2), pp. 187 to 273 (1981-82), and C. G. Rattey, *Photopolymerization of Surface Coatings*, A. Wiley Interscience Pub. (1982).

The heat-curable functional group which can be used includes functional groups excluding the above-specified acidic groups. Examples of the heat-curable functional groups are described, for example, in Tsuyoshi Endo, *Netsukokasei Kobunshi no Seimitsuka*, C.M.C. (1986), Yuji Harasaki, *Saishin Binder Gijutsu Binran*, Chapter II-I, Sogo Gijutsu Center (1985), Takayuki Ohtsu, *Acryl Jushi no Gosei Sekkei to Shin-Yotokaihatsu*, Chubu Kei-ei Kaihatsu Center Shuppanbu (1985), and Eizo Ohmori, *Kinosei Acryl Kei Jushi*, Techno System (1985).

Specific examples of the heat-curable functional group which can be used include —OH, —SH, —$NH_2$, —$NHZ^4$(wherein $Z^4$ represents a hydrocarbon group, for example, an alkyl group having from 1 to 10 carbon atoms which may be substituted (e.g., methyl, ethyl, propyl, butyl, hexyl, octyl, decyl, 2-chloroethyl, 2-methoxyethyl, and 2-cyanoethyl), a cycloalkyl group having from 4 to 8 carbon atoms which may be substituted (e.g., cycloheptyl and cyclohexyl), an aralkyl group having from 7 to 12 carbon atoms which may be substituted (e.g., benzyl, phenethyl, 3-phenylpropyl, chlorobenzyl, methylbenzyl, and methoxybenzyl), and an aryl group which may be substituted (e.g., phenyl, tolyl, xylyl, chlorophenyl, bromophenyl, methoxyphenyl, and naphthyl)),

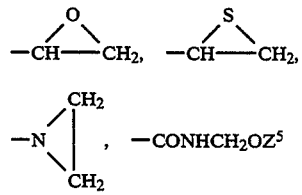

(wherein $Z^5$ represents a hydrogen atom or an alkyl group having from 1 to 8 carbon atoms (e.g., methyl, ethyl, propyl, butyl, hexyl, and octyl), —N=C=O and

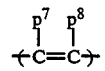

(wherein $p^7$ and $p^8$ each represents a hydrogen atom, a halogen atom (e.g., chlorine and bromine) or an alkyl group having from 1 to 4 carbon atoms (e.g., methyl and ethyl)).

Other examples of the functional group include polymerizable double bond groups, for example,

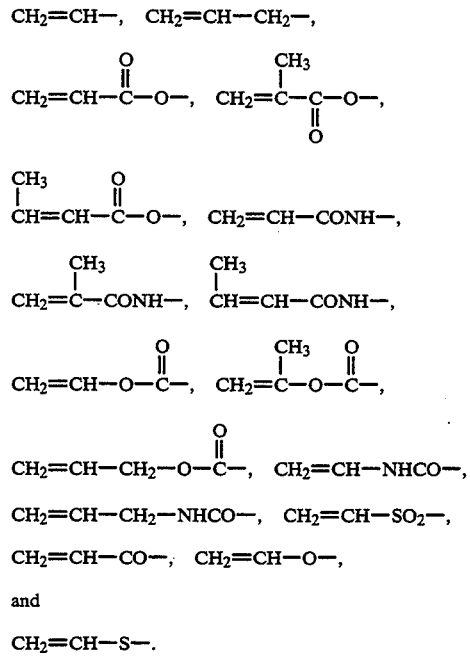

and $CH_2$=CH—S—.

In order to introduce at least one functional group selected from the curable functional groups into the resin (B) according to the present invention, a method comprising introducing the functional group into a polymer by high molecular reaction or a method comprising copolymerizing at least one monomer containing at least one of the functional groups with a monomer corresponding to the repeating unit of the general formula (III) and, if desired, a monomer corresponding to the polar group-containing polymer component can be employed.

The above-described high molecular reaction can be carried out by using conventionally known low molecular synthesis reactions. For the details, reference can be made to, e.g., Nippon Kagakukai (ed.), *Shin-Jikken Kagaku Koza*, Vol. 14, "Yuki Kagobutsu no Gosei to Hanno" (I) to (V), published by Maruzen Co., and Yoshio Iwakura and Keisuke Kurita, *Hannosei Kobunshi*, and literature references cited therein.

Suitable examples of the monomers containing the functional group capable of inducing heat- and/or photocurable reaction include vinyl compounds which are copolymerizable with the monomers corresponding to the repeating unit of the general formula (III) and contain the above-described functional group. More specifically, compounds similar to those described in detail above as the polar group-containing components which further contain the above-described functional group in their substituent are illustrated.

Specific examples of the heat- and/or photocurable functional group-containing repeating unit are described below, but the present invention should not be construed as being limited thereto. In the following formulae, $R^{31}$ has the same meaning as $R^{21}$ defined above; $e_1$ and $e_2$ each represents —H or —$CH_3$; $R^{32}$ represents —CH=$CH_2$ or —$CH_2$CH=$CH_2$; $R^{33}$ represents —CH=$CH_2$,

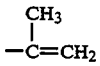

or —CH=$CHCH_3$; $R^{34}$ represents —CH=$CH_2$, —$CH_2$CH=$CH_2$,

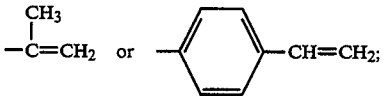

$R^{35}$ represents —OH or —$NH_2$; Z represents S or O; s represents an integer of from 1 to 4; t represents an integer of from 2 to 11; u represents an integer of from 1 to 11; and v represents an integer of from 1 to 10.

(c-1)

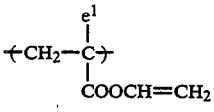

(c-2)

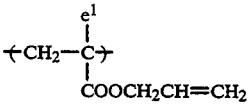

-continued (c-3)

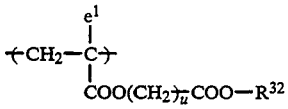

(c-4)

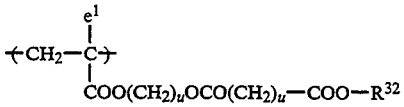

(c-5)

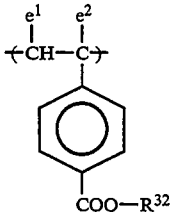

(c-6)

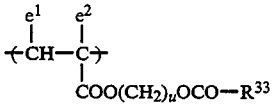

(c-7)

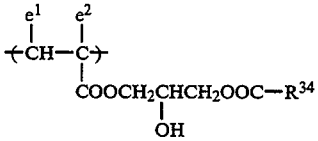

(c-8)

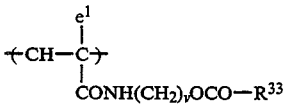

(c-9)

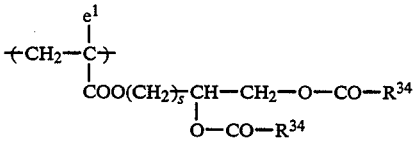

(c-10)

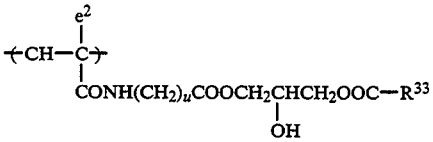

(c-11)

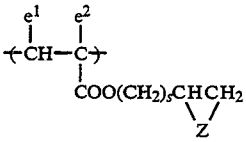

(c-12)

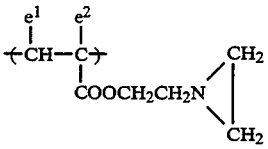

(c-13)

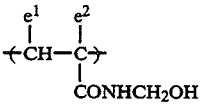

-continued (c-14)

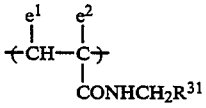

(c-15)

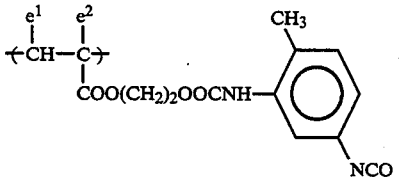

(c-16)

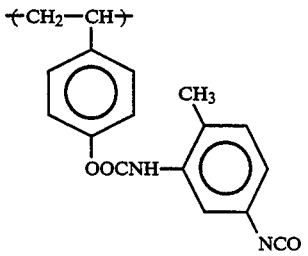

(c-17)

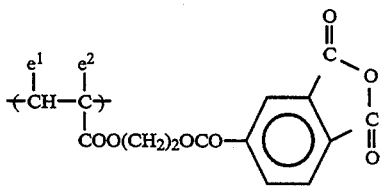

(c-18)

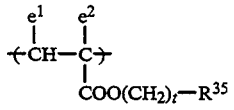

(c-19)

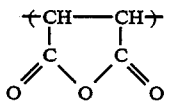

(c-20)

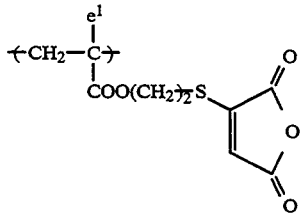

Also, the resin (B) used in the present invention may further contain other polymer components polymerizable with the polymer component represented by the general formula (III) and, of desired the polymer component having the polar group together with these polymer components. Specific examples of such other polymer components are the same compounds as those illustrated above as other polymer components included in the polymer the resin (A). However, in this case, the content of other polymer components existing in the binder (B) is not more than 30% by weight, and preferably not more than 20% by weight.

Of the resin (B) used in the present invention, the resin (B') having the polar group bonded to one terminal of the polymer main chain can be synthesized by using a polymerization initiator or a chain transfer agent each .having the polar group or a specific reactive group capable of being converted into the polar group in the molecule at the polymerization of the above-described monomers. Specifically, the resin (B') can easily be prepared by an ion polymerization process, in which a various kind of reagent is reacted at the terminal of a living polymer obtained by conventionally known anion polymerization or cation polymerization; a radical polymerization process, in which radical polymerization is performed in the presence of a polymerization initiator and/or chain transfer agent which contains the specific polar group in the molecule thereof; or a process in which a polymer having a reactive group (for example, an amino group, a halogen atom, an epoxy group, and an acid halide group) at the terminal obtained by the above-described ion polymerization or radical polymerization is subjected to a high molecular reaction to convert the terminal reactive group into the specific polar group.

More specifically, reference can be made, e.g., to P. Dreyfuss and R. P. Quirk, *Encycl. Polym. Sci. Eng.*, Vol. 7, p. 551 (1987), Yoshiki Nakajo and Yuya Yamashita, *Senryo to Yakuhin*, Vol. 30, p. 232 (1985), Akira Ueda and Susumu Nagai, *Kagaku to Kogyo*, Vol. 60, p. 57 (1986) and literature references cited therein.

Specific examples of chain transfer agents which can be used include mercapto compounds containing the polar group or the reactive group capable of being converted into the polar group (e.g., thioglycolic acid, thiomalic acid, thiosalicyclic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mecaptobutanesulfonic acid, 2-mercaptoethanol, 1-mercapto-2-propanol, 3-mercapto-2-butanol, mercaptophenol, 2-mercaptoethylamine, 2-mercaptoimidazole, 2-mercapto-3-pyridinol, 4-(2-mercaptoethyloxycarbonyl)phthalic anhydride, 2-mercaptoethylphosphonic acid, and monomethyl 2-mercaptoethylphosphonate), and alkyl iodide compounds containing the polar group or the polar group-forming reactive group (e.g., iodoacetic acid, iodopropionic acid, 2-iodoethanol, 2-iodoethanesulfonic acid, and 3-iodopropanesulfonic acid). Of these compounds, mercapto compounds are preferred.

Specific examples of the polymerization initiators containing the polar group or the reactive group include 4,4'-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-methyl-N-(2-hydroxyethyl)propionamide], 2,2'-azobis{2-methyl-N-[1,1-bis(hydroxymethyl)-2-hydroxyethyl]propionamide}, 2,2'-azobis(2-[1-(2-hydroxyethyl)-2-imidazolin-2-yl]-propane}, 2,2'-azobis[2-(2-imidazolin-2-yl)-propane], and 2,2'-azobis[2-(4,5,6,7-tetrahydro-1H-1,3-diazepin-2-yl)propane].

The chain transfer agent or polymerization initiator is usually used in an amount of from 0.5 to 15 parts by weight, preferably from 2 to 10 parts by weight, per 100 parts by weight of the total monomers employed.

The weight average molecular weight of the resin can be controlled in the desired range by properly selecting kinds of the polymerization initiator and chain transfer agent, amounts of these components, polymerization temperature, concentration of the monomers, polymerization solvent, etc., as conventionally known in a polymerization reaction.

Also, when the resin (B) used in the present invention contains a photo- and/or heat-curable functional group, a crosslinking agent for accelerating the crosslinking of the resin(s) in the layer can be employed together. As the crosslinking agent, compounds which are ordinary used as crosslinking agents can be used. Specifically, the compounds described, for example, in Shinzo Yamashita and Tosuke Kaneko, *Kakyozai* (*Cross-linking Agent*) Handbook, published by Taiseisha, 1981, and Kobunshi Gakkai (ed.), *Kobunshi* (*Polymer*) *Data Handbook Kisohen* (*Foundation*), Baifukan, 1986 can be employed.

Specific examples of the crosslinking agent used are organic silane series compounds (e.g., silane coupling agents such as vinyltrimethoxysilane, vinyltributoxysilane, γ-glycidoxypropyltrimethoxysilane, γ-mercaptopropyltriethoxysilane, and γ-aminopropyltriethoxysilane), polyisocyanate series compounds (e.g., toluylene diisocyanate, o-toluylene diisocyanate, diphenylmethane diisocyanate, triphenylmethane triisocyanate, polymethylenepolyphenyl isocyanate, hexamethylene diisocyanate, isophorone diisocyanate, and high molecular polyisocyanate), polyol series compounds (e.g., 1,4-butanediol, polyoxypropylene glycol, polyoxyalkylene glycol, and 1,1,1-trimethylolpropane), polyamine series compounds (e.g., ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (e.g., the compounds described in Hiroshi Kakiuchi, *Epoxy Resin*, published by Shokodo (1985), Kuniyuki Hashimoto., *Epoxy Resin*, published by Nikkan Kogyo Shinbunsha (1969), melamine resins (e.g., the compounds described in Ichiro Miwa & Hideo Matsunaga, *Urea.Melamine* Resins, published by Nikkan Kogyo Shinbunsha (1969)), and poly(-meth)-acrylate series compounds (e.g., the compounds described in Shin Ohgawara, Takeo Saegusa, & Thoshinobu Higashi-mura, *Oligomer*, published by Kodansha (1976), Eizo Ohmori, *Kinosei* (*Functional*) *Acrylic Resins*, published by Techno System (1985), specific examples including polyethylene glycol diacrylate, neopentyl glycol diacrylate, 1,6-hexanediol acrylate,. trimethylolpropane triacrylate, pentaerythritol polyacrylate, hisphenol A diglycidyl ether diacrylate, oligoester acrylate and methacrylate compounds thereof).

The amount of the crosslinking agent used in the present invention is preferably from 0.5 to 30% by weight, and more preferably from 1 to 10% by weight.

In the present invention, if necessary, a reaction accelerator may be added to the binder resin for accelerating the crosslinking reaction in the photo-conductive layer.

In the case of the reaction system wherein the crosslinking reaction forms a chemical bond between functional groups, examples of the reaction accelerator are organic acids such as acetic acid, propionic acid, butyric acid, benzenesulfonic acid, and p-toluenesulfonic acid.

When the crosslinking reaction is a polymerizing reaction system, examples of the reaction accelerator are polymerization initiators (e.g., peroxides and azobis series compounds, and preferably azobis series polymerization initiators) and monomers having a poly-functional polymerizable group (e.g., vinyl methacrylate, allyl methacrylate, ethylene glycol acrylate, polyethylene glycol diacrylate, divinylsuccinic acid ester, divinyladipic acid ester, diallylsuccinic acid ester, 2-methylvinyl methacrylate, and divinylbenzene).

When the binder resin used in the present invention contains a photo- and/or heat-curable functional group in the resin (B), the coated layer is crosslinked or heat-cured after coating the coating composition for forming the photoconductive layer. For carrying out the crosslinking or heat-curing, for example, the drying condition is adjusted severer than the drying condition for making conventional electrophotographic light-sensitive materials. For example, drying is carried out at a high temperature and/or for a long time, or, preferably after drying the coated layer to remove the coating solvent, the layer is further subjected to a heat treatment. For example, the coated layer is treated at a temperature of from 60° C. to 120° C. for from 5 to 120 minutes. When the above-described reaction accelerator is used, the coated layer can be treated under a milder condition.

Furthermore, in the present invention, the binder resin used in the photoconductive layer may contain other resin(s) known for inorganic photoconductive substance described above in addition to the resin (A) and resin (B) according to the present invention. However, the amount of other resins descried above should not exceed 30% by weight of the total binder resins since, if the amount is more than 30% by weight, the effects of the present invention are remarkably reduced.

Representative other resins which can be employed together with the resins (A) and (B) according to the present invention include vinyl chloride-vinyl acetate copolymers, styrene-butadiene copolymers, styrene-methacrylate copolymers, methacrylate copolymers, acrylate copolymers, vinyl acetate copolymers, polyvinyl butyral resins, alkyd resins, silicone resins, epoxy resins, epoxyester resins, and polyester resins.

Specific examples of other resins used are described, for example, in Takaharu Shibata and Jiro Ishiwatari, *Kobunshi* (*High Molecular Materials*), 17, 278 (1968), Harumi Miyamoto and Hidehiko Takei, *Imaging* No. 8, 9 (1973), Koichi Nakamura, *Kiroku Zairyoyo Binder no Jissai Gijutsu* (*Practical Technique of Binders for Recording Materials*), Cp. 10, published by C. M. C. Shuppan (1985), D. Tatt, S. C. Heidecker *Tappi*, 49, No. 10, 439 (1966), E. S. Baltazzi, R. G. Blanckette, et al., *Photo. Sci. Eng.*, 16, No. 5, 354 (1972), Nguyen Chank Keh, Isamu Shimizu and Eiichi Inoue, *Denshi Shashin Gakkaishi* (*Journal of Electrophotographic Association*), 18, No. 2, 22 (1980), JP-B-50-31011, JP-A-53-54027, JP-A-54-20735, JP-A-57-202544 and JP-A-58-68046.

The total amount of binder resin used in the photoconductive layer according to the present invention is preferably from 10 to 100 parts by weight, more preferably from 15 to 50 parts by weight, per 100 parts by weight of the inorganic photoconductive substance.

The ratio of resin (A) to resin (B) used in the present invention is preferably 0.05 to 0.80/0.95 to 0.20, more preferably 0.10 to 0.50/0.90 to 0.50 by means of a weight ratio of resin (A)/resin (b).

When the total amount of binder resin used is less than 10 parts by weight per 100 parts by weight of the inorganic photoconductive substance, it may be difficult to maintain the film strength of the. photoconductive layer. On the other hand, when it is more than 100 parts by weight, the electrostatic characteristics may decrease and the image forming performance may degrade to result in the formation of poor duplicated image.

When the weight ratio of resin (A)/resin (B) is less than 0.05, the effect for improving the electrostatic characteristics may be reduced. On the other hand, when it is more than 0.8, the film strength of the photoconductive layer may not be sufficiently maintained in some cases (particularly, in case of using as an electrophotographic printing plate precursor).

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide, preferably zinc oxide.

As the spectral sensitizing dye according to the present invention, various dyes can be employed individually or as a combination of two or more thereof. Examples of the spectral sensitizing dyes are carbonium dyes, diphenylmethane dyes, triphenylmethane dyes, xanthene dyes, phthalein dyes, polymethine dyes (e.g., oxonol dyes, merocyanine dyes, cyanine dyes,. rhodacyanine dyes, and styryl dyes), and phthalocyanine dyes (including metallized dyes). Reference can be made to, for example, in Harumi Miyamoto and Hidehiko Takei, *Imaging,* 1973, No. 8, 12, C. J. Young et al., *RCA Review,* 15, 469 (1954), Ko-hei Kiyota et al., *Denkitsushin Gakkai Ronbunshi,* J 63-C, No. 2, 97 (1980), Yuji Harasaki et al., *Kogyo Kagaku Zasshi,* 66, 78 and 188 (1963), and Tadaaki Tani, *Nihon Shashin Gakkaishi,* 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described, for example, in F. M. Hamer, *The Cyanine Dyes and Related Compounds.* Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research disclosure,* 216, 117 to 118 (1982).

The light-sensitive material of the present invention is particularly excellent in that the performance properties are not liable to variation even when various kinds of sensitizing dyes are employed together.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging,* 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka,* Chaps. 4 to 6, Nippon Kagaku Joho K. K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges usually from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin,* 14, No. 1, pp. 2 to 11 (1975), Hiroyuki Moriga, *Nyumon Tokushushi no Kagaku,* Kobunshi Kankokai (1975), and M. F. Hoover, *J. Macromol. Sci. Chem.,* A-4(6), pp. 1327 to 1417 (1970).

The electrophotographic light-sensitive material according to the present invention can be utilized in any known electrophotographic process. Specifically, the light-sensitive material of the present invention is employed in any recording system including a PPC system and a CPC system in combination with any developer including a dry type developer and a liquid developer. In particular, the light-sensitive material is preferably employed in combination with a liquid developer in order to obtain the excellent effect of the present invention since the light-sensitive material is capable of providing faithfully duplicated image of highly accurate original.

Further, a color duplicated image can be produced by using it in combination with a color developer in addition to the formation of black and white image. Reference can be made to methods described, for example, in Kuro Takizawa, Shashin Koqyo, 33, 34 (1975) and Masayasu Anzai, *Denshitsushin Gakkai Gijuksu Kenkyu Hokoku,* 77, 17 (1977).

Moreover, the light-sensitive material of the present invention is effective for recent other uses utilizing an electrophotographic process. For instance, the light-sensitive material containing photoconductive zinc oxide as a photoconductive substance is employed as an offset printing plate precursor, and the light-sensitive material containing photoconductive zinc oxide or titanium oxide which does not cause environmental pollution and has good whiteness is employed as a recording material for forming a block copy usable in an offset printing process or a color proof.

In accordance with the present invention, an electrophotographic light-sensitive material which exhibits excellent electrostatic characteristics (particularly, under severe conditions) and mechanical strength and provides clear images of good quality can be obtained. The electrophotographic light-sensitive material according to the present invention is suitable for producing a lithographic printing plate. It is also advantageously employed in the scanning exposure system using a semiconductor laser beam.

The present invention will now be illustrated in greater detail with reference to the following examples, but it should be understood that the present invention is not to be construed as being limited thereto.

SYNTHESIS EXAMPLE 1 OF RESIN (A)

Synthesis

A mixed solution of 66 g of methyl methacrylate, 30 g of methyl acrylate, 4 g of acrylic acid, 28 g of Initiator (I-1) shown below and 150 g of tetrahydrofuran was heated to 50° C. under nitrogen gas stream.

Initiator (I-1)

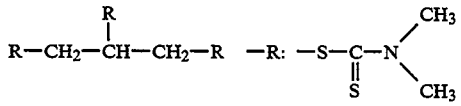

The solution was irradiated with light from a high-pressure mercury lamp of 400 W at a distance of 10 cm through a glass filter, and a photopolymerization reaction was conducted for 10 hours. The reaction mixture obtained was reprecipitated in one liter of methanol, and the precipitates formed were collected by filtration and dried to obtain 72 g of resin (A-1) shown below having a weight average molecular weight (which was a value measured by a GPC method and calculated in terms of polystyrene) (hereinafter simply referred to as Mw) of $8\times10^3$.

Resin (A-1)

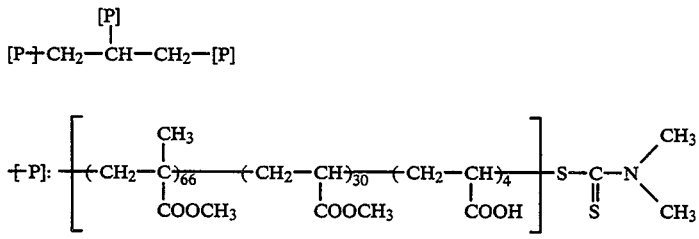

SYNTHESIS EXAMPLE 2 OF RESIN (A)

Synthesis of Resin (A-2)

Resin (A-2) was synthesized under the same condition as described in Synthesis Example 1 of Resin (A) except for using 36.3 g of Initiator (I-2) shown below in place of 28 g of Initiator (I-1). The yield of the resulting polymer was 75 g and the Mw was $7.5\times10^3$.

Initiator (I-2)

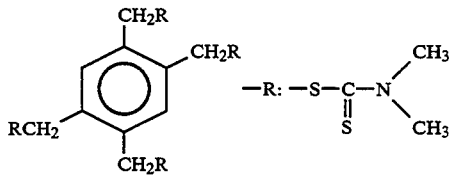

Resin (A-2)

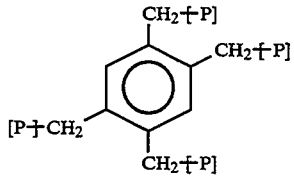

-continued

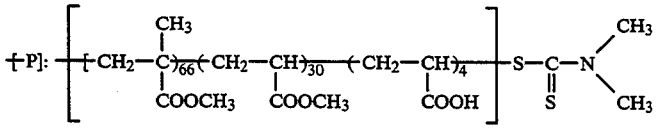

SYNTHESIS EXAMPLES 3 TO 9 OF RESIN (A)

Synthesis of Resins (A-3) to (A-9)

Each of resins (A) shown in Table A below was synthesized under the same condition as described in Synthesis Example 1 of Resin (A) except for using a mixed solution of 95 g of 2-chlorophenyl methacrylate, 5 g of methacrylic acid, 0.10 mole of Initiator shown in Table A below and 100 g of tetrahydrofuran. The Mw of each of the resulting resins (A) was in a range of from $6\times10^3$ to $8\times10^3$.

TABLE A

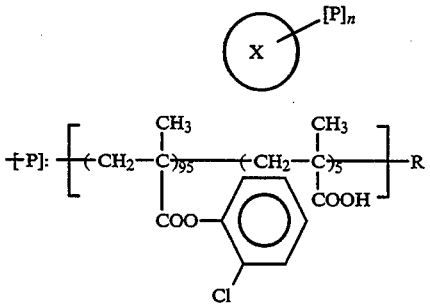

| Synthesis Example of Resin (A) | Initiator (I) | —R | X |
|---|---|---|---|
| 3 | 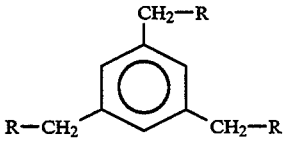 | (I-3) 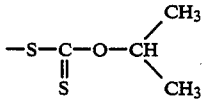 | 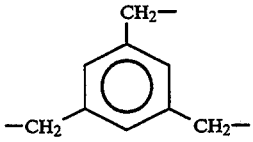 |
| 4 | 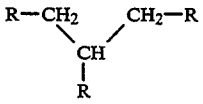 | (I-4) 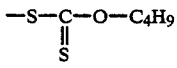 | 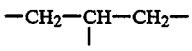 |
| 5 | 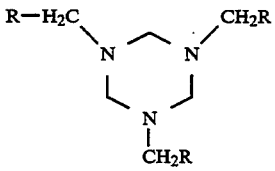 | (I-5) 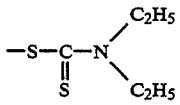 | 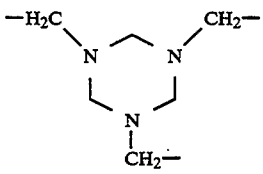 |
| 6 | 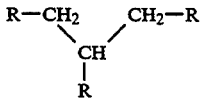 | (I-6) 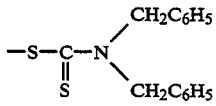 | 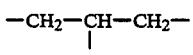 |
| 7 | 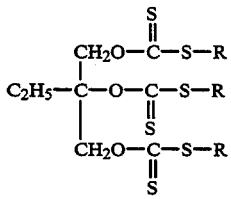 | (I-7) $-CH_2C_6H_5$ | 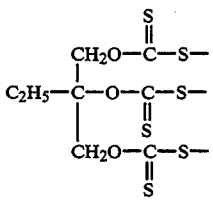 |

TABLE A-continued

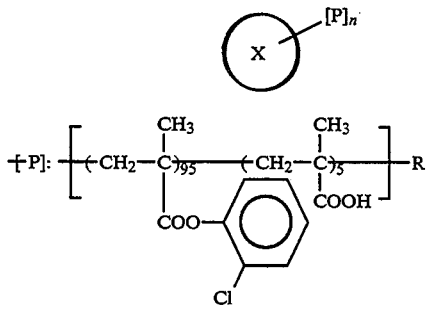

| Synthesis Example of Resin (A) | Initiator (I) | —R | X |
|---|---|---|---|
| 8 | 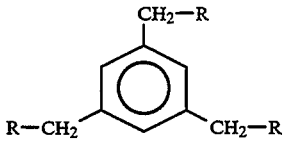 | (I-8) 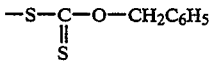 | 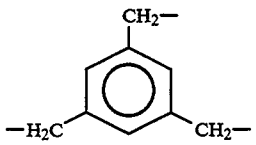 |
| 9 | 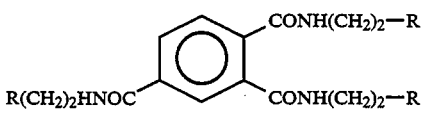 | (I-9) 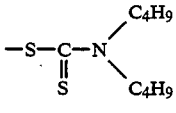 | 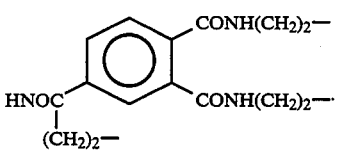 |

SYNTHESIS EXAMPLES 10 TO 25 OF RESIN (A)

Synthesis of Resins (A-10) to (A-25)

Each of the resins (A) shown in Table B below was synthesized under the same condition as described in Synthesis Example 1 of Resin (A) except for using each of monomers corresponding to the polymer components shown in Table B below in place of methyl methacrylate, methyl acrylate and acrylic acid. The Mw of each of the resulting resins (A) was in a range of from $6\times10^3$ to $9\times10^3$.

TABLE B

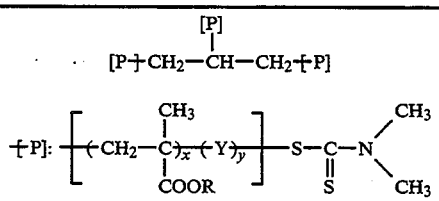

| Synthesis Example of Resin (A) | (A) | —R | —Y— | x/y (weight ratio) |
|---|---|---|---|---|
| 10 | A-10 | $-CH_2C_6H_5$ | $-CH_2-CH(COOH)-$ | 95/5 |
| 11 | A-11 | $-CH_2C_6H_5$ | $-CH_2-C(CH_3)(CONH-C_6H_4-COOH)-$ | 94/6 |
| 12 | A-12 | 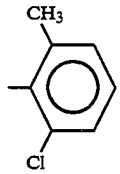 | $-CH_2-CH(COOH)-$ | 95/5 |

TABLE B-continued
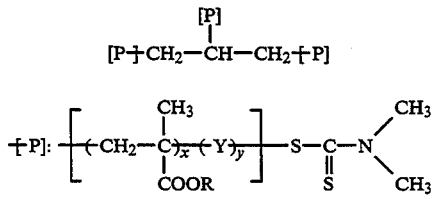
| Synthesis Example of Resin (A) | (A) | —R | —Y— | x/y (weight ratio) |
|---|---|---|---|---|
| 13 | A-13 | 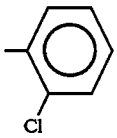 | 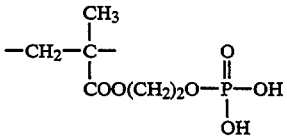 | 94/6 |
| 14 | A-14 | 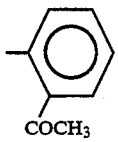 | 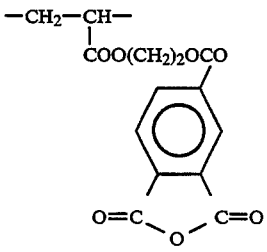 | 93/7 |
| 15 | A-15 | 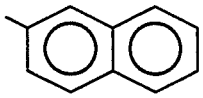 | 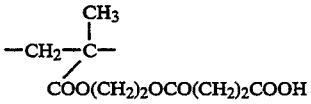 | 95/5 |
| 16 | A-16 | 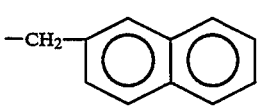 | 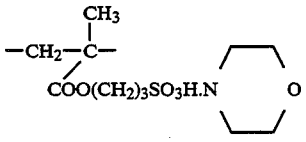 | 96/4 |
| 17 | A-17 | $-CH_3$ | 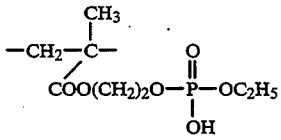 | 94/6 |
| 18 | A-18 | 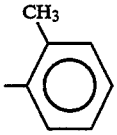 | 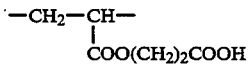 | 95/5 |
| 19 | A-19 | $-CH_2C_6H_5$ | 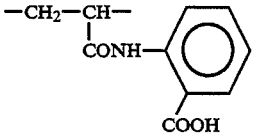 | 94/6 |
| 20 | A-20 | 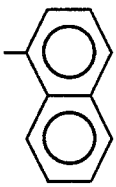 | 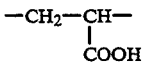 | 95/5 |

TABLE B-continued

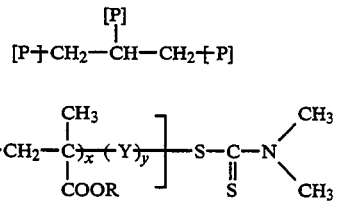

| Synthesis Example of Resin (A) | (A) | —R | —Y— | x/y (weight ratio) |
|---|---|---|---|---|
| 21 | A-21 | 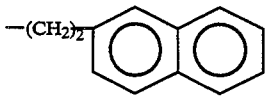 | 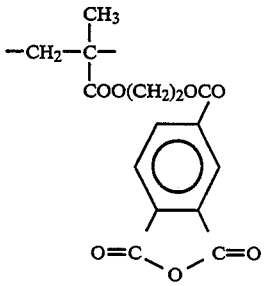 | 94/6 |
| 22 | A-22 | $-C_2H_5$ | 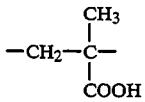 | 94/6 |
| 23 | A-23 | $-C_6H_5$ | 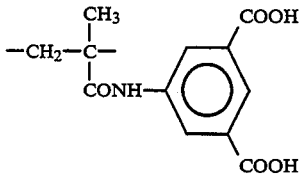 | 97/3 |
| 24 | A-24 | 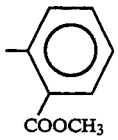 | 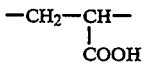 | 95/5 |
| 25 | A-25 | $-CH_2C_6H_5$ | 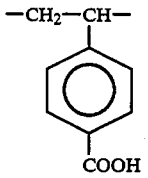 | 96/4 |

SYNTHESIS EXAMPLES 26 TO 30 OF RESIN (A).

Synthesis of Resins (A-26) to (A-30)

A mixture of 33.9 g of Initiator (I-2) described above and monomers corresponding to the polymer components shown in Table C below was heated to 40° C. under nitrogen gas stream, followed by light irradiation for polymerization in the same manner as described in Synthesis Example 1 of Resin (A). The solid material obtained was collected, dissolved in 250 ml of tetrahydrofuran, reprecipitated in 1.5 liters of methanol, and the precipitates formed were collected by filtration and dried. The yield of each of the resulting polymers was in a range of from 60 to 75 g and the Mw thereof was in a range of from $6\times10^3$ to $8\times10^3$.

TABLE C

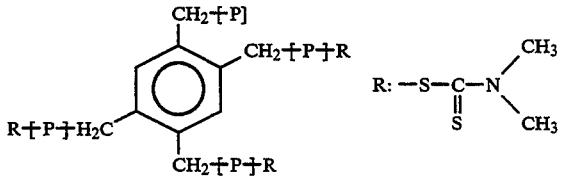

| Synthesis Example of Resin (A) | (A) | Component of (P) (by weight) |
|---|---|---|
| 26 | (A-26) | 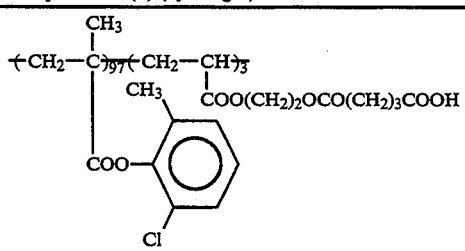 |
| 27 | (A-27) | 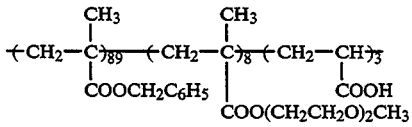 |
| 28 | (A-28) | 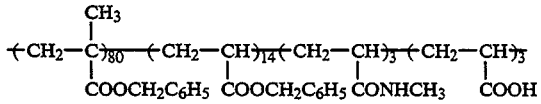 |
| 29 | (A-29) | 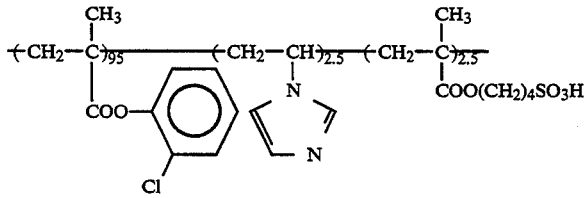 |
| 30 | (A-30) | 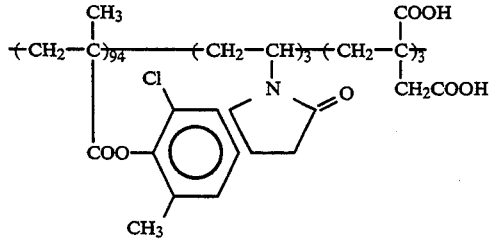 |

-continued

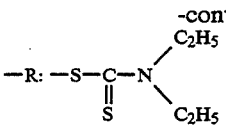

SYNTHESIS EXAMPLE 101 OF RESIN (A)

Synthesis of Resin (A-101)

A mixture of 47.5 g of benzyl methacrylate, 24.8 g of Initiator (I-101) shown below and 70 g of tetrahydrofuran was heated to 40° C. under nitrogen gas stream.

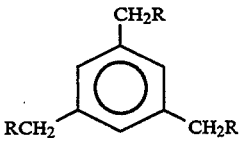

Initiator (I-101)

The solution was irradiated with light from a high-pressure mercury lamp of 400 W at a distance of 10 cm through a glass filter, and a photopolymerization reaction was conducted for 10 hours. To the reaction mixture was added a mixed solution of 2.5 g of methacrylic acid and 5 g of tetrahydrofuran, and the mixture was further irradiated with light in the same manner as above for 10 hours at 40° C. under nitrogen gas stream. The reaction mixture was reprecipitated in 800 ml of a solvent mixture of water and methanol (2:1 by volume), and the precipitates formed were collected by filtration and dried. The yield of the resulting polymer was 38 g and the Mw was $8.5\times10^3$.

Resin (A-101)

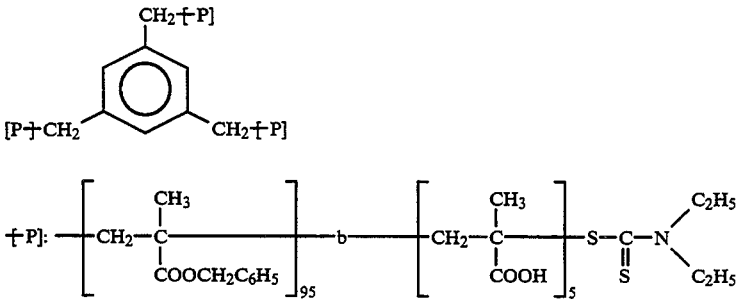

In the above formula, "-b-" represents that each of the repeating units bonded to -b- is present in the form of a block polymer component (hereinafter the same).

SYNTHESIS EXAMPLES 102 TO 110 OF RESIN (A)

Synthesis of Resins (A-102) to (A-110)

Each of resins (A) shown in Table D shown below was synthesized under the same condition as described in Synthesis Example 101 of Resin (A) except for using each of monomers corresponding to the polymer components shown in Table D below in place of 47.5 g of benzyl methacrylate and 2.5 g of methacrylic acid. The Mw of each of the resulting resins (A) was in a range of from $7\times10^3$ to $1\times10^4$.

TABLE D

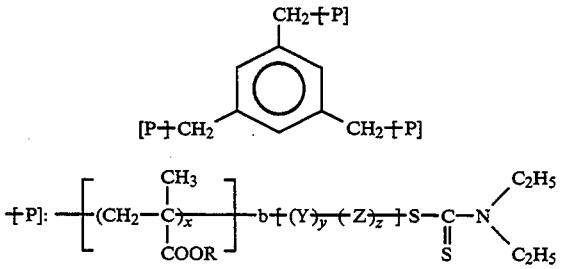

| Synthesis Example of Resin (A) | (A) | —R | —Y— | —Z— | x/y/z |
|---|---|---|---|---|---|
| 102 | A-102 | 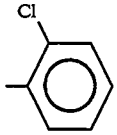 | — | $-CH_2-CH-$ (COOH) | 95/0/5 |
| 103 | A-103 | 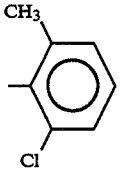 | — | $-CH_2-C-$ ($CH_3$, COOH) | 94/0/6 |
| 104 | A-104 | 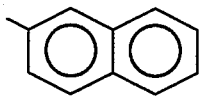 | — | $-CH_2-CH-$ ($COO(CH_2)_2COOH$) | 95/0/7 |
| 105 | A-105 | 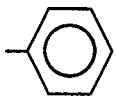 | $-CH_2-CH-$ ($COOCH_2C_6H_5$) | $-CH_2-CH-$ (COOH) | 87/10/3 |
| 106 | A-106 | 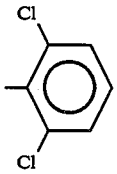 | $-CH_2-CH-$ (N, O) | $-CH_2-C-$ ($CH_3$, COOH) | 93/3/4 |

TABLE D-continued

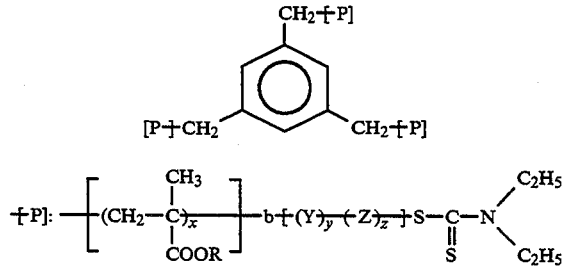

| Synthesis Example of Resin (A) | (A) | —R | —Y— | —Z— | x/y/z |
|---|---|---|---|---|---|
| 107 | A-107 | 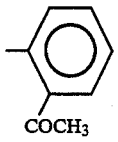 | — | 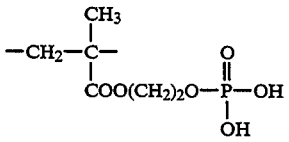 | 94/0/6 |
| 108 | A-108 | 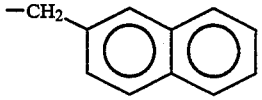 | 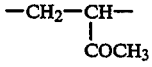 | 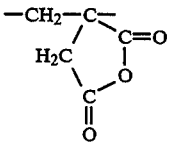 | 89/5/6 |
| 109 | A-109 | 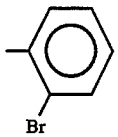 | — | 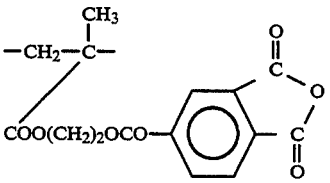 | 92/0/8 |
| 110 | A-110 | $-CH_2C_6H_5$ | 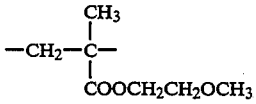 | 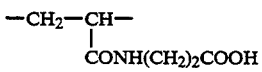 | 87/8/5 |

SYNTHESIS EXAMPLES 111 TO 116 OF RESIN (A)

Synthesis of Resins (A-111) to (A-116)

A mixed solution of 40 g of 2-chlorophenyl methacrylate, 0.02 moles of Initiator shown in Table E below and 50 g of tetrahydrofuran was subjected to light irradiation for 8 hours in the same manner as described in Synthesis Example 101 of Resin (A). To the reaction mixture was added a mixed solution of 7.5 g of benzyl methacrylate, 2.5 of methacrylic acid and 10 g of tetrahydrofuran, followed by reacting in the same manner as described in Synthesis Example 101 of Resin (A). The Mw of each of the resulting resin (A) was in a range of from $5\times10^3$ to $9\times10^3$.

TABLE E
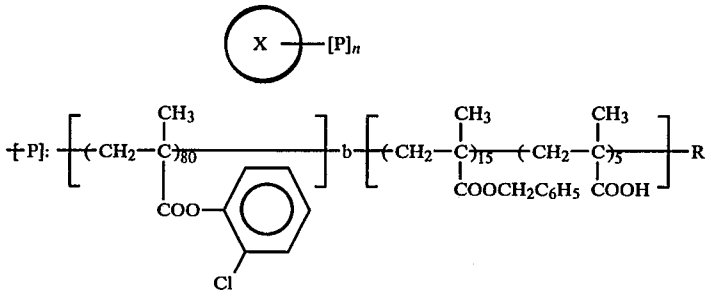
| Synthesis Example of Resin (A) | Resin (A) | Initiator (I) | | —R | X—[P]n |
|---|---|---|---|---|---|
| 111 | (A-111) | 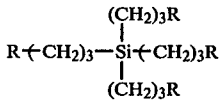 | (I-102) | 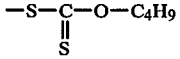 | 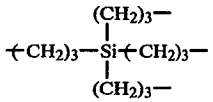 |
| 112 | (A-112) | 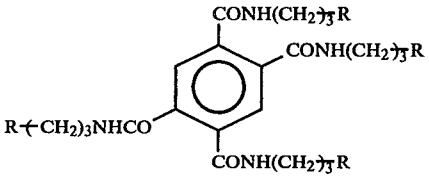 | (I-103) | 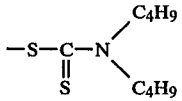 | 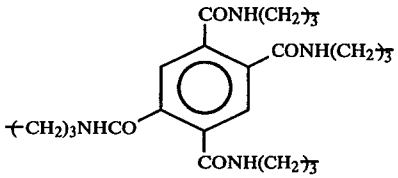 |
| 113 | (A-113) | 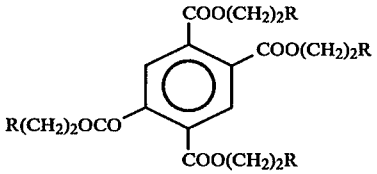 | (I-104) | 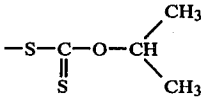 | 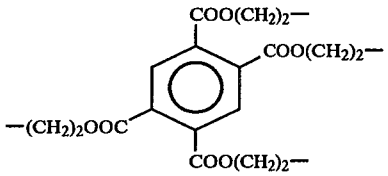 |
| 114 | (A-114) | 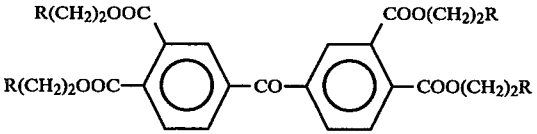 | (I-105) | 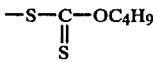 | 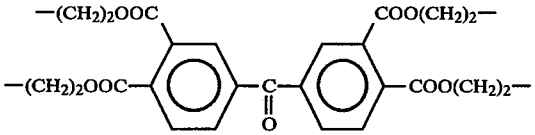 |

TABLE E-continued
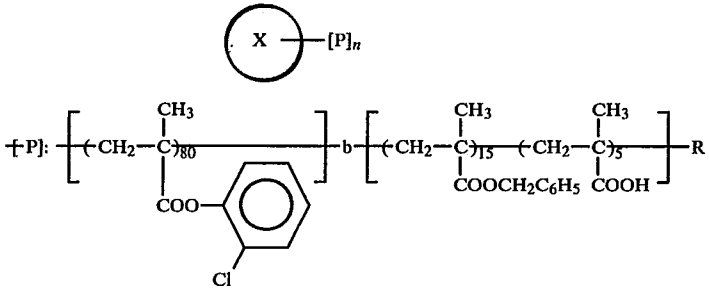
| Synthesis Example of Resin (A) | Resin (A) | Initiator (I) | | —R | X—[P]$_n$ |
|---|---|---|---|---|---|
| 115 | (A-115) | 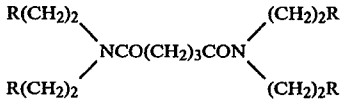 | (I-106) | 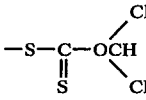 | 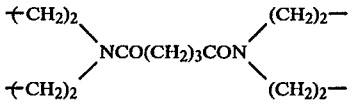 |
| 116 | (A-116) | 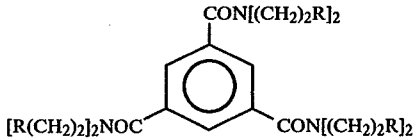 | (I-107) | 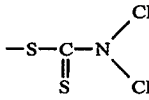 | 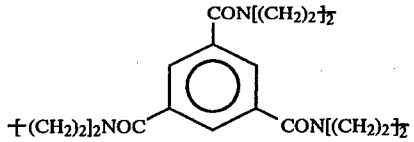 |

SYNTHESIS EXAMPLES 117 TO 125 OF RESIN (A)

Synthesis of Resins (A-117) to (A-125)

A mixed solution of 52.5 g of methyl methacrylate, 17.5 g of methyl acrylate, 44 g of Initiator (I-108 shown below and 75 g of tetrahydrofuran was irradiated with light for 15 hours in the same manner as described in Synthesis Example 101 of Resin (A) at 50° C. under nitrogen gas stream.

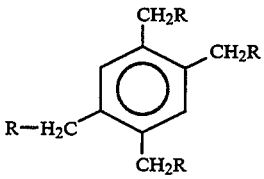

Initiator (I-108)

-continued

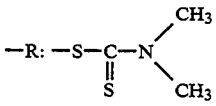

To the reaction mixture was added a mixture of monomers corresponding to the polymer components shown in Table F below and 25 g of tetrahydrofuran, and the mixture was further irradiated with light for 15 hours in the same manner as described above. The Mw of each of the resulting resin (A) was in a range of from $5\times10^3$ to $8\times10^3$.

TABLE F

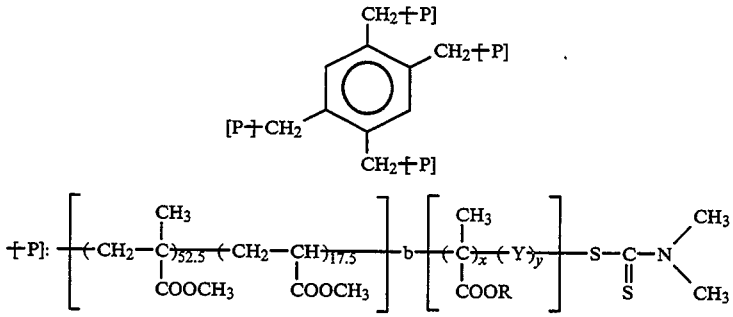

| Synthesis Example of Resin (A) | (A) | —R | —Y— | x/y |
|---|---|---|---|---|
| 117 | A-117 | 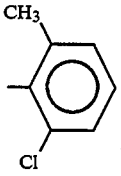 | 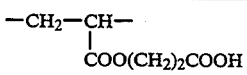 | 28/2 |
| 118 | A-118 | 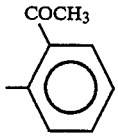 | 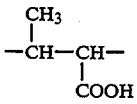 | 28.5/1.5 |
| 119 | A-119 | 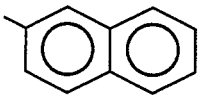 | 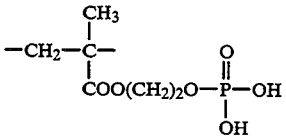 | 27/3 |
| 120 | A-120 | 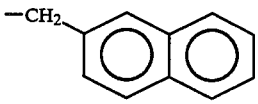 | 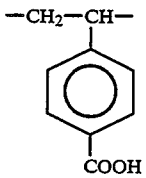 | 27.5/2.5 |
| 121 | A-121 | 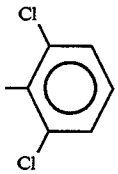 | 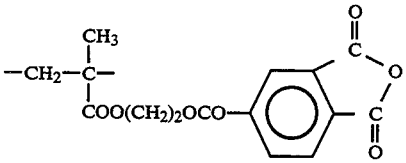 | 26/4 |

TABLE F-continued

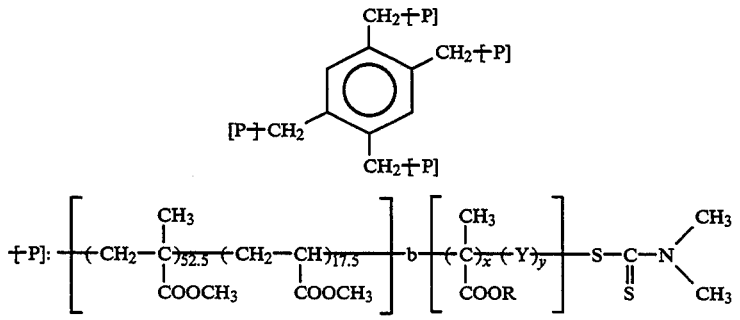

| Synthesis Example of Resin (A) | (A) | —R | —Y— | x/y |
|---|---|---|---|---|
| 122 | A-122 | $-C_6H_5$ | 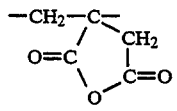 | 27/3 |
| 123 | A-123 | 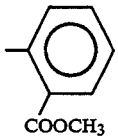 | 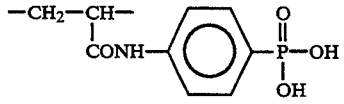 | 27.5/2.5 |
| 124 | A-124 | 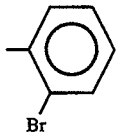 | 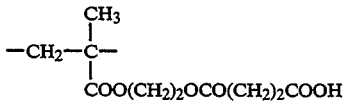 | 26.5/3.5 |
| 125 | A-125 | 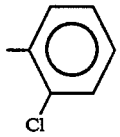 | 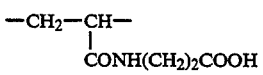 | 27.5/2.5 |

SYNTHESIS EXAMPLES 126 TO 131 OF RESIN (A)

Synthesis of Resins (A-126) to (A-131)

Each of resins (A) shown in Table G below was synthesized in the same manner as described in Synthesis Example 101 of Resin (A) except for using monomers corresponding to the polymer components shown in Table G below and 0.03 moles of Initiator (I-109), The Mw of each of the resulting resin (A) was in a range of from $4\times10^3$ to $9\times10^3$.

Initiator (I-109)

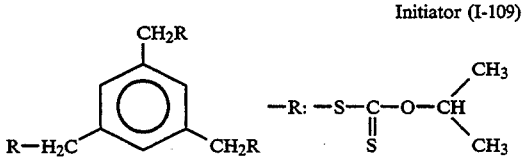

TABLE G

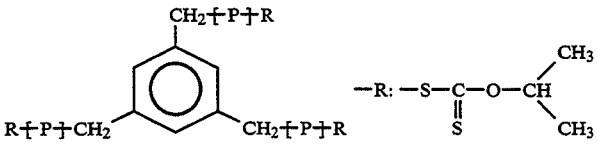

| Synthesis Example of Resin (A) | (A) | ⊣P⊢ (by weight) |
|---|---|---|
| 126 | (A-126) | 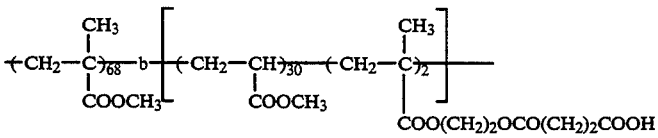 |

TABLE G-continued

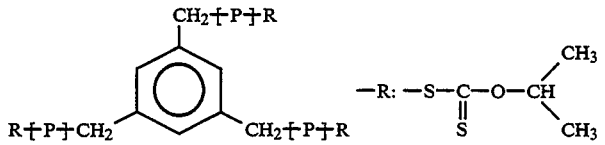

| Synthesis Example of Resin (A) | (A) | ⟊P⟊ (by weight) |
|---|---|---|
| 127 | (A-127) | 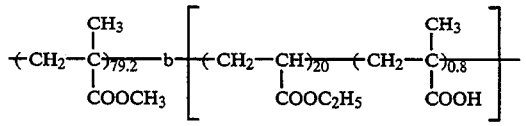 |
| 128 | (A-128) | 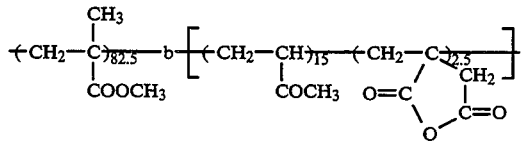 |
| 129 | (A-129) | 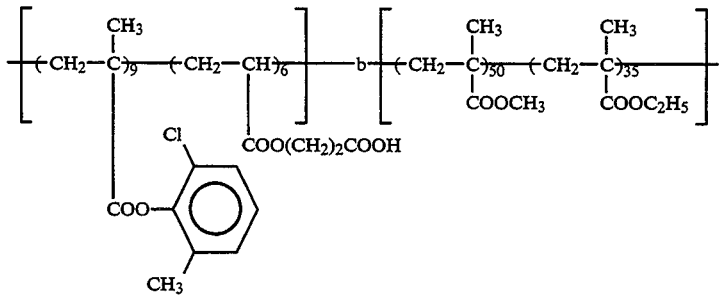 |
| 130 | (A-130) | 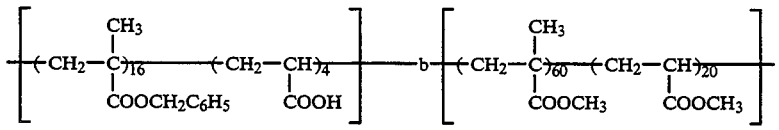 |
| 131 | (A-131) | 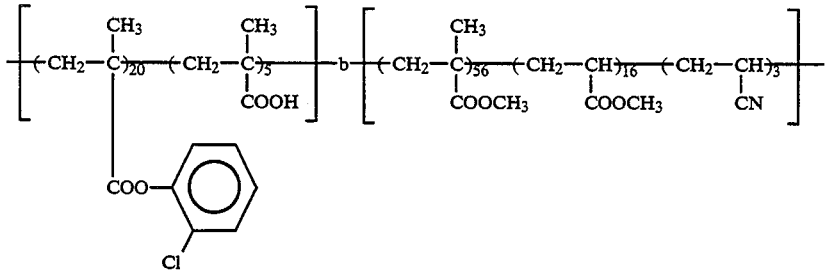 |

Synthesis examples of the resin (B) are specifically illustrated below.

SYNTHESIS EXAMPLE 1 OF RESIN (B)

Synthesis of Resin (B-1)

A mixed solution of 100 g of ethyl methacrylate, 150 g of toluene and 50 g of methanol was heated to 75° C. under nitrogen gas stream. After adding 0.8 g of 4,4'-azobis(4-cyanovaleric acid) (hereinafter simply referred to as A.C.V.) to the resulting mixture, the reaction was carried out for 5 hours and, after further adding thereto 0.2 g of A.C.V., the reaction was carried out for 4 hours. The Mw of the resulting polymer was $8\times10^4$.

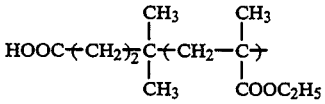

Resin (B-1)

SYNTHESIS EXAMPLE 2 OF RESIN (B)

Synthesis of Resin (B-2)

A mixed solution of 85 g of methyl methacrylate, 15 g of methyl acrylate, 0.8 g of thioglycolic acid and 200 g of toluene was heated to 75° C. under nitrogen gas stream. Then, after adding 0.8 g of 1,1'-azobis(cyclohexane-1-carbonitrile) (hereinafter simply referred to as A.B.C.C.) to the resulting mixture, the reaction was carried out for 5 hours and, after further adding thereto 0.2 g of A.B.C.C., the reaction was carried out for 7 hours. The Mw of the resulting polymer was $7.5\times10^4$.

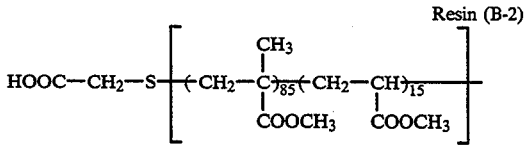

SYNTHESIS EXAMPLE 3 OF RESIN (B)

Synthesis of Resin (B-3)

A mixed solution of 73.5 g of methyl methacrylate, 15 g of methyl acrylate, 10 g of styrene, 1.5 g of acrylic acid and 200 g of toluene was heated to 75° C. under nitrogen gas stream. Then, after adding 1.0 g of 2,2'-azobis(isobutyronitrile) (hereinafter simply referred to as A.I.B.N.) to the resulting mixture, the reaction was carried out for 4 hours and, after further adding thereto 0.6 g of A.I.B.N., the reaction was-carried out for 4 hours. The Mw of the resulting polymer was $5.0\times10^4$.

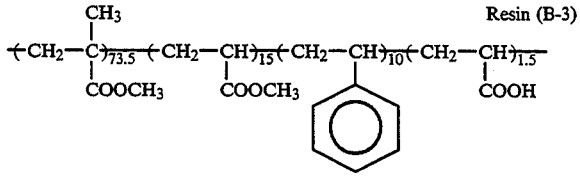

SYNTHESIS EXAMPLES 4 TO 28 OF RESIN (B)

Synthesis of Resins (B-4) to (B-28)

Each of the resin (B) shown in Table H below was synthesized in a similar manner described in Synthesis Examples 1 to 3 of Resin (B). The Mw of each of the resulting resins (B) was in a range of from $6\times10^4$ to $20\times10^4$.

TABLE H

| Synthesis Example of Resin (B) | (B) | Polymer (by weight) |
|---|---|---|
| 4 | B-4 | 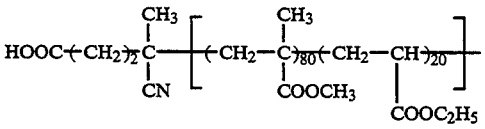 |
| 5 | B-5 | 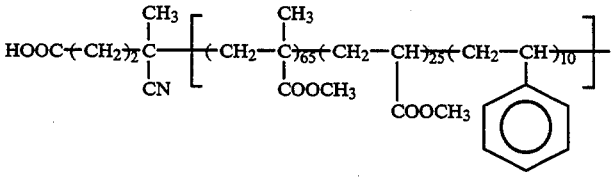 |
| 6 | B-6 | 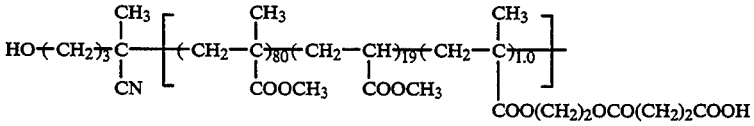 |
| 7 | B-7 | 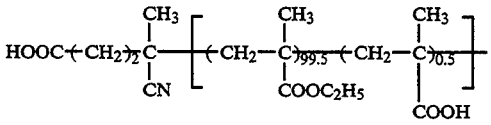 |
| 8 | B-8 | 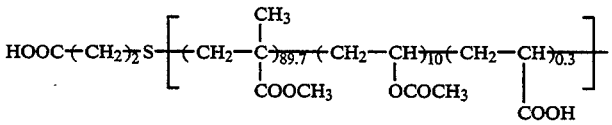 |
| 9 | B-9 | 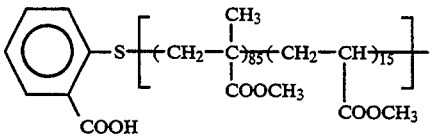 |
| 10 | B-10 | 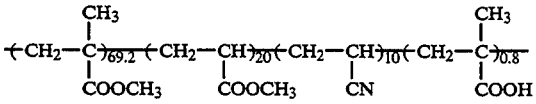 |

TABLE H-continued
| Synthesis Example of Resin (B) | (B) | Polymer (by weight) |
|---|---|---|
| 11 | B-11 | 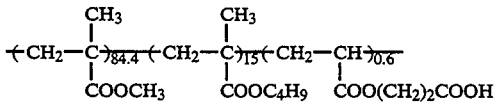 |
| 12 | B-12 | 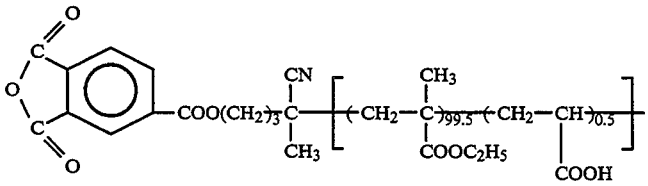 |
| 13 | B-13 | 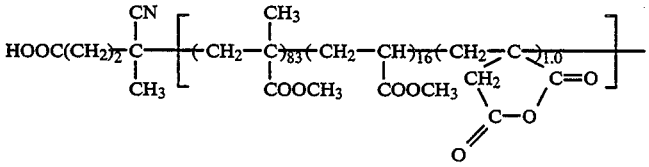 |
| 14 | B-14 | 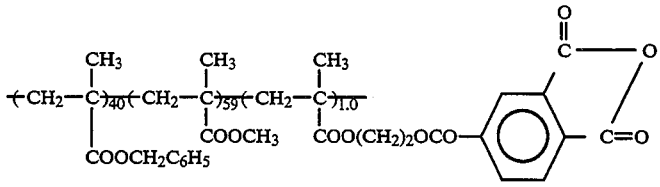 |
| 15 | B-15 | 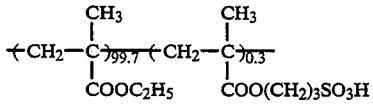 |
| 16 | B-16 | 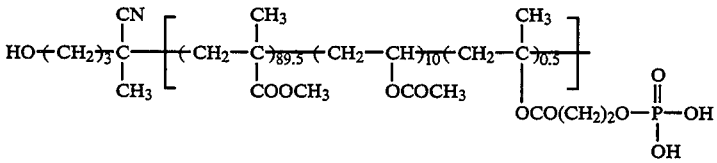 |
| 17 | B-17 | 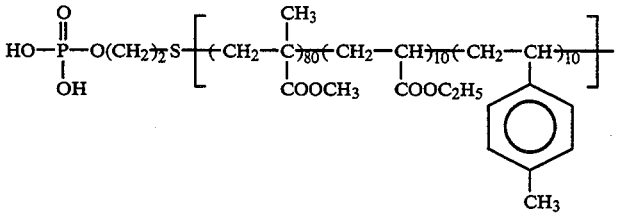 |
| 18 | B-18 | 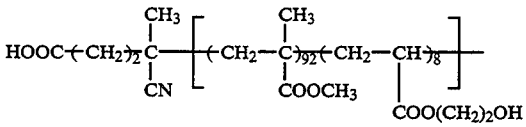 |
| 19 | B-19 | 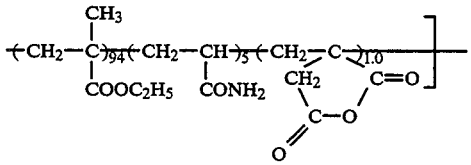 |
| 20 | B-20 | 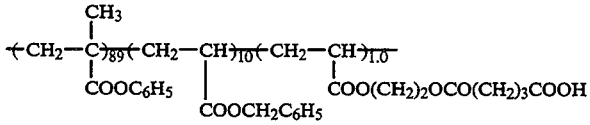 |

TABLE H-continued

| Synthesis Example of Resin (B) | (B) | Polymer (by weight) |
|---|---|---|
| 21 | B-21 | 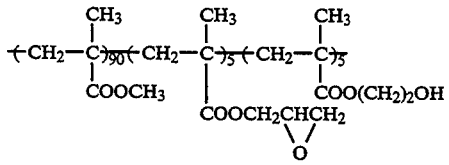 |
| 22 | B-22 | 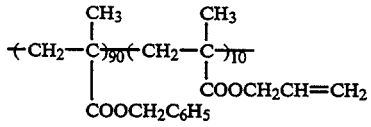 |
| 23 | B-23 | 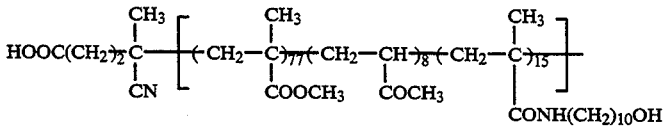 |
| 24 | B-24 | 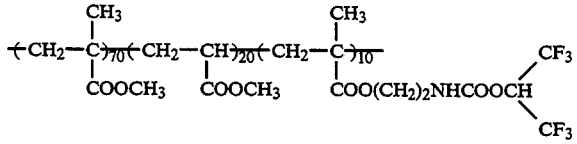 |
| 25 | B-25 | 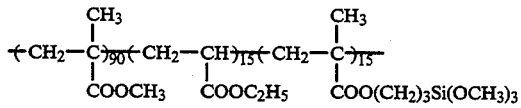 |
| 26 | B-26 | 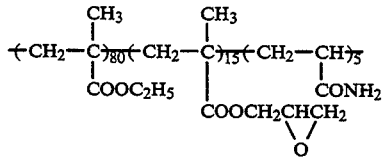 |
| 27 | B-27 | 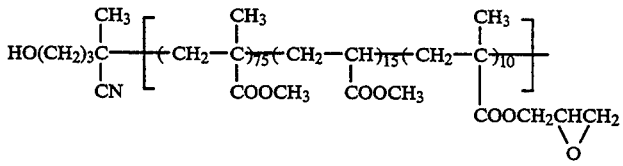 |
| 28 | B-28 | 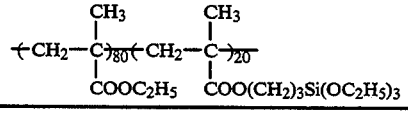 |

EXAMPLE 1

A mixture of 6 g (solid basis, hereinafter the same) of Resin (A-3), 34 g (solid basis, hereinafter the same) of Resin (B-24), 200 g of photoconductive zinc oxide, 0.018 g of Cyanine Dye (I) shown below, 0.15 g of salicylic acid and 300 g of toluene was dispersed by a homogenizer (manufactured by Nippon Seiki K.K.) at $6\times10^3$ r.p.m. for 6 minutes, and then 0.20 g of phthalic anhydride and 0.003 g of o-chlorophenol were added thereto, followed by dispersing at $1\times10^3$ r.p.m. for 1 minute to prepare a coating composition for a light-sensitive layer. The coating composition was coated on paper, which had been subjected to electrically conductive treatment, by a wire bar at a dry coverage of 22 g/m$^2$, followed by drying at 110° C. for 10 seconds and then heating at 140° C. for 30 minutes. The coated material was then allowed to stand in a dark place at 20° C. and 65% RH (relative humidity) for 24 hours to prepare an electrophotographic light-sensitive material.

Cyanine Dye (I)

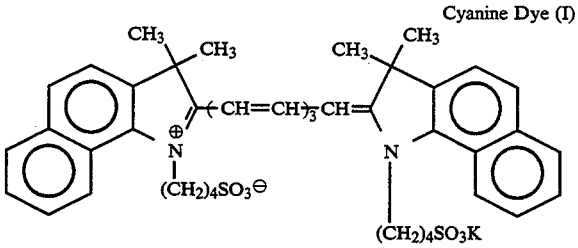

COMPARATIVE EXAMPLE A-1

An electrophotographic light-sensitive material was prepared in the same manner as in Example 1, except for using 6 g of Resin (R-1) shown below in place of 6 g of Resin (A-3).

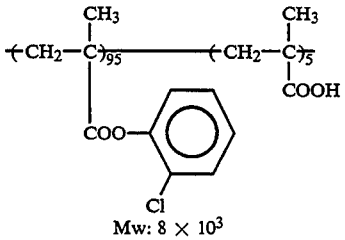

Resin (R-1)

Mw: $8 \times 10^3$

COMPARATIVE EXAMPLE B-1

An electrophotographic light-sensitive material was prepared in the same manner as in Example 1, except for using 6 g of Resin (R-2) shown below in place of 6 g of Resin (A-3).

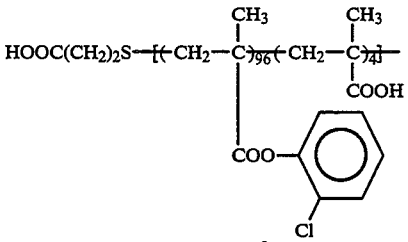

Resin (R-2)

Mw: $8.5 \times 10^3$

With each of the light-sensitive material thus prepared, film property (surface smoothness), image forming performance and printing property were evaluated.

The results obtained are shown in Table 1A below.

TABLE IA

| | Example 1 | Comparative Example A-1 | Comparative Example B-1 |
|---|---|---|---|
| Smoothness of Photo-*1 conductive Layer (sec/cc) | 300 | 310 | 315 |
| Image Forming*2 Performance | | | |
| Condition I | Very good | Good | Good |
| Condition II | Good | Unevenness in half tone area | Unevenness in half tone area |
| Condition III | Good | Unevenness in half tone area | Unevenness in half tone area |
| Water Retentivity of*3 Light-Sensitive Material | No background stain | Slight background stain | Slight background stain |
| Printing Durability*4 | 8,000 | 4,000 | 6,000 |

The evaluation of each item shown in Table 1A was conducted in the following manner.

*1) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*2) Image Forming Performance

After the light-sensitive material was allowed to stand for one day under the ambient condition shown below, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ("ELP-T" produced by Fuji Photo Film Co., Ltd.), washed with a rinse solution of iso-paraffinic solvent ("Isopar G" manufactured by Esso Chemical K.K.) and fixed. The duplicated image obtained was visually evaluated for fog and image quality.

The ambient condition at the time of image formation was 20° C. and 65% RH (Condition I), 30° C. and 80% RH (Condition II) or 15° C. and 30% RH (Condition III).

*3) Water Retentivity of Light-Sensitive Material

A degree of hydrophilicity of the light-sensitive material after being subjected to an oil-desensitizing treatment for use as a printing plate was evaluated by processing under the following forced condition. Specifically, the light-sensitive material without subjecting to plate making was passed once through an etching machine using an aqueous solution obtained by diluting an oil-desensitizing solution ("ELP-EX" produced by Fuji Photo Film Co., Ltd.) to a five-fold volume with distilled water. The material thus-treated was mounted on a printing machine ("Hamada Star Type 8005X" manufactured by Hamada Star K.K.) and printing was conducted. The extent of background stain occurred on the 50th print was visually evaluated.

*4) Printing Durability

The light-sensitive material was subjected to plate making in the same manner as described in *2) above, passed once through an etching machine with ELP-EX. Printing was conducted using the plate thus-obtained and a number of prints on which background stain was first visually observed was determined.

As can be seen from the results shown in Table 1A above, the light-sensitive material according to the present invention provided duplicated images having very clear highly accurate image portions such as fine lines, fine letters and dots of continuous gradation and no background stain. Further, it provided stably clear duplicated images even under the severe ambient condition such as a low temperature and low humidity condition or a high temperature and high humidity condition at the time of image formation.

On the contrary, although the light-sensitive materials of Comparative Examples A-1 and B-1 provided good duplicated images under the ambient condition of normal temperature and normal humidity (Condition I), the occurrence of unevenness of density was observed in the highly accurate image portions, in particular, half tone areas of continuous gradation upon the fluctuation of ambient condition at the time of image formation.

When each of the light-sensitive materials was subjected to the oil-desensitizing treatment under the forced condition of using a solution of a reduced oil-desensitizing power, followed by practical printing, and the extent of adhesion of ink on prints was evaluated as described in *3), the adhesion of ink was observed in cases of using the light-sensitive material of Comparative Examples A-1 and B-1, although no adhesion of ink occurred according to the present invention.

As a result of conducting plate making, oil-desensitizing treatment under an usual condition and printing as described in *4), the light-sensitive material according to the present invention provided 8,000 prints of faithfully duplicated images without the occurrence of background stain. On the contrary, with the light-sensitive materials of Comparative Examples A-1 and B-1, only 4,000 prints and 6,000 prints could be obtained, respectively. Further, when the plate making was conducted under the severe condition of Condition II or Condition III, poor images on prints were obtained from the start of printing due to poor reproducibility of duplicated images.

From these results it is believed that the resin (A) according to the present invention suitably interacts with zinc oxide to form the condition under which an oil-desensitizing reaction proceeds easily and sufficiently with an oil-desensitizing solution and that the remarkable improvement in film strength is achieved by the action of the resin (B).

EXAMPLE 2

A mixture of 6 g of Resin (A-12), 34 g of Resin (B-2), 200 g of photoconductive zinc oxide, 0.020 g of Methine Dye (II) shown below, 0.20 g of N-hydroxymalinimide and 300 g of toluene was treated in the same manner as described in Example 1 to prepare an electro-photographic light-sensitive material.

Methine Dye (II)

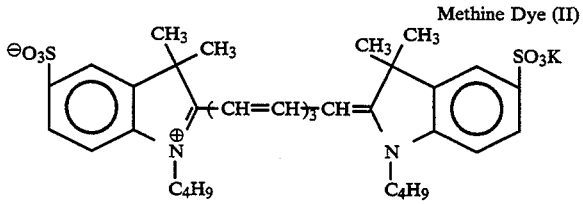

With the light-sensitive material thus-prepared, a film property in terms of surface smoothness, electrostatic characteristics, and image forming performance were evaluated. Further, printing property was evaluated when it was used as an electrophotographic lithographic printing plate precursor.

The results obtained are shown in Table 2A below.

TABLE 2A

| | | |
|---|---|---|
| Smoothness of Photoconductive Layer (sec/cc) | | 305 |
| Electrostatic characteristics*5) | | |
| $V_{10}$ (-V) | Condition I | 765 |
| | Condition II | 745 |
| | Condition III | 760 |
| D.R.R. (%) | Condition I | 89 |
| | Condition II | 84 |
| | Condition III | 88 |
| $E_{1/10}$ (erg/cm$^2$) | Condition I | 24 |
| | Condition II | 21 |
| | Condition III | 30 |
| $E_{1/100}$ (erg/cm$^2$) | Condition I | 38 |
| | Condition II | 41 |
| | Condition III | 48 |
| Image Forming Performance | | |
| | Condition I | Very good |
| | Condition II | Good |
| | Condition III | Good |
| Water Retentivity of Light-Sensitive Material | | Good |
| Printing Durability | | 8,000 |

The evaluation of the electrostatic characteristics was conducted in the following manner.

*5) Electrostatic Characteristics

The light-sensitive material was charged with a corona discharge to a voltage of −6 kV for 20 seconds in a dark room at 20° C. and 65% RH using a paper analyzer ("Paper Analyzer SP-428" manufactured by Kawaguchi Denki K.K.). Ten seconds after the corona discharge, the surface potential $V_{10}$ was measured. The sample was allowed to stand in the dark for an additional 120 seconds, and the potential $V_{130}$ was measured. The dark decay retention rate (DRR; %), i.e., percent retention of potential after dark decay for 120 seconds, was calculated from the following equation:

$$DRR\ (\%)=(V_{130}/V_{10})\times 100$$

Separately, the surface of photoconductive layer was charged to −500 V with a corona discharge and then exposed to monochromatic light having a wavelength of 780 nm, and the time required for decay of the surface potential $V_{10}$ to one-tenth was measured to obtain an exposure amount $E_{1/10}$ (erg/cm$^2$).

Further, the light-sensitive material was charged to −500 V with a corona discharge in the same manner as described for the measurement of $E_{1/10}$, then exposed to monochromatic light having a wavelength of 780 nm, and the time required for decay of the surface potential $V_{10}$ to one-hundredth was measured to obtain an exposure amount $E_{1/100}$ (erg/cm$^2$).

The measurements were conducted under ambient condition of 20° C. and 65% RH (Condition I), 30° C. and 80% RH (Condition II) or 15° C. and 30% RH (Condition III).

As is apparent from the results shown in Table 2A above, the light-sensitive material according to the present invention had good surface smoothness which indicated a uniform dispersion state of zinc oxide. The electrostatic characteristics were stable and good even when the ambient condition was fluctuated. With the images forming performance, duplicated images faithful to the original were obtained without the formation of background stain. Further, when it was used as an offset master plate precursor and subjected to the oil-desensitizing treatment and printing, 8,000 prints of good quality were obtained.

EXAMPLES 3 TO 22

Each electrophotographic light-sensitive material was prepared in the same manner as described in Example 2, except for replacing Resin (A-12) and Resin (B-2) with each of Resins (A) and (B) shown in Table 3A below, respectively.

The electrostatic characteristics of the resulting light-sensitive materials were evaluated in the same manner as described in Example 2.

TABLE 3A

| Example No. | Resin (A) | Resin (B) | Example No. | Resin (A) | Resin (B) |
|---|---|---|---|---|---|
| 3 | A-4 | B-3 | 13 | A-16 | B-13 |
| 4 | A-6 | B-4 | 14 | A-18 | B-15 |
| 5 | A-7 | B-1 | 15 | A-19 | B-16 |

TABLE 3A-continued

| Example No. | Resin (A) | Resin (B) | Example No. | Resin (A) | Resin (B) |
|---|---|---|---|---|---|
| 6 | A-8 | B-5 | 16 | A-20 | B-17 |
| 7 | A-9 | B-6 | 17 | A-21 | B-18 |
| 8 | A-10 | B-7 | 18 | A-24 | B-19 |
| 9 | A-11 | B-8 | 19 | A-25 | B-20 |
| 10 | A-13 | B-9 | 20 | A-26 | B-25 |
| 11 | A-14 | B-11 | 21 | A-27 | B-8 |
| 12 | A-15 | B-12 | 22 | A-29 | B-12 |

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example 2, more than 8,000 good prints were obtained respectively.

It can be seen from the results described above that each of the light-sensitive materials according to the present invention was satisfactory in all aspects of the surface smoothness of the photoconductive layer, electrostatic characteristics, and printing property.

EXAMPLES 23 TO 26

Each electrophotographic light-sensitive material was prepared in the same manner as described in Example 1, except for replacing Cyanine Dye (I) with each of the dye shown in Table 4A below.

TABLE 4A

| Example No. | | Dye |
|---|---|---|
| 23 | (III) | 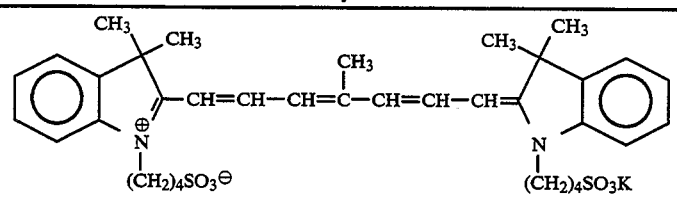 |
| 24 | (IV) | 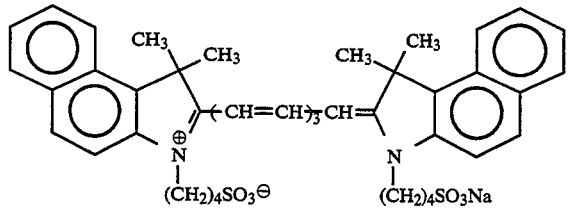 |
| 25 | (V) | 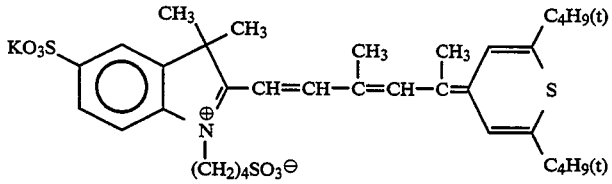 |
| 26 | (VI) | 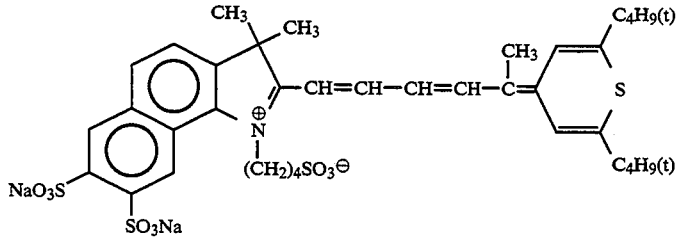 |

Each of the light-sensitive materials according to the present invention was excellent in charging properties, dark charge retention rate, and photosensitivity, and provided clear duplicated images free from background fog even when processed under severe conditions of high temperature and high humidity (30° C. and 80% RH) and low temperature and low humidity (15° C. and 30% RH).

EXAMPLES 27 AND 28

A mixture of 6 g of Resin (A-26) and 34 g of Resin (B-8) (Example 27) or Resin (A-11) and 34 g Resin (B-13) (Example 28), 200 g of zinc oxide, 0.02 g of uranine, 0.03 g of Methine Dye (VII) shown below, 0.03 g of Methine Dye (VIII) shown below, 0.18 g of p-hydroxybenzoic acid and 300 g of toluene was dispersed by a homogenizer at $7\times10^3$ r.p.m. for 5 minutes to prepare a coating composition for a light-sensitive layer. The coating composition was coated on paper, which had been subjected to electrically conductive treatment, by a wire bar at a dry coverage of 18 g/m$^2$, and dried for 20 seconds at 110° C. Then, the coated material was allowed to stand in a dark place for 24 hours under the conditions of 20° C. and 65% RH to prepare each electrophotographic light-sensitive material.

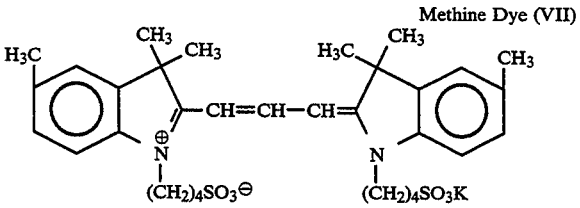

Methine Dye (VII)

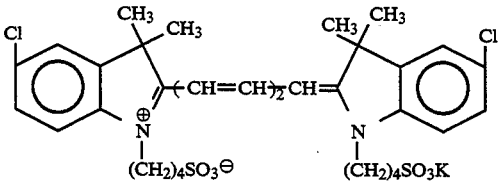

Methine Dye (VIII)

COMPARATIVE EXAMPLE C-1

An electrophotographic light-sensitive material was prepared in the same manner as in Example 28, except for replacing 6 g of Resin (A-11) with 6 g of Resin (R-1) described above.

With each of the light-sensitive materials thus prepared, various characteristics were evaluated in the same manner as in Example 2, except that some electrostatic characteristics and image forming performance were evaluated according to the following test methods.

*6) Electrostatic Characteristics: $E_{1/10}$ and $E_{1/100}$

The surface of the photoconductive layer was charged to -400 V with corona discharge, and then irradiated by visible light of the illuminance of 2.0 lux. Then, the time required for decay of the surface potential ($V_{10}$) to 1/10 or 1/100 thereof was determined, and the exposure amount $E_{1/10}$ or $E_{1/100}$ (lux.sec) was calculated therefrom.

*7) Image Forming Performance:

The electrophotographic light-sensitive material was allowed to stand for one day under the ambient condition described below, the light-sensitive material was subjected to plate making by a full-automatic plate making machine (ELP-404V manufactured by Fuji Photo Film Co., Ltd.) using ELP-T as a toner. The duplicated image thus obtained was visually evaluated for fog and image quality. The ambient condition at the time of image formation was 20° C. and 65% RH (Condition I), 30° C. and 80% RH (Condition II) or 15° C. and 30% RH (Condition III). The original used for the duplication was composed of cuttings of other originals pasted up thereon.

The results obtained are shown in Table 5A below.

TABLE 5A

| | | Example 27 | Example 28 | Comparative Example C-1 |
|---|---|---|---|---|
| Binder Resin | | (A-26)/(B-8) | (A-11)/(B-13) | (R-1)/(B-13) |
| Smoothness of Photoconductive Layer (sec/cc) | | 400 | 410 | 390 |
| Electrostatic Characteristics*6) | | | | |
| $V_{10}$ (-V) | Condition I | 710 | 610 | 680 |
| | Condition II | 695 | 585 | 660 |
| | Condition III | 705 | 615 | 685 |
| D.R.R. (%) | Condition I | 94 | 88 | 90 |
| | Condition II | 90 | 84 | 88 |
| | Condition III | 94 | 87 | 90 |
| $E_{1/10}$ (lux/sec) | Condition I | 8.4 | 10.3 | 9.6 |
| | Condition II | 8.0 | 10.0 | 9.2 |
| | Condition III | 9.1 | 11.3 | 10.5 |
| $E_{1/100}$ (lux/sec) | Condition I | 13 | 16 | 14 |
| | Condition II | 15 | 18 | 16 |
| | Condition III | 18 | 22 | 19 |
| Image-Forming*7) Performance | Condition I | Very Good | Good | Good |
| | Condition II | Very Good | Good | Edge mark of cutting, Unevenness in half tone area |
| | Condition III | Very Good | Good | Unevenness of white spots in image portion |
| Water Retentivity of Light-Sensitive Material | | Very Good | Good | Good |
| Printing Durability | | 8,000 | 8,000 | 5,000 |

From the results shown in Table 5A above, it can be seen that each light-sensitive material exhibits good properties with respect to the surface smoothness of the photoconductive layer and electrostatic characteristics.

With respect to image-forming performance, the edge mark of cuttings pasted up was observed as background fog in the non-image areas or the occurrence of unevenness of white spots in the image portion was observed in the sample of Comparative Example C-1 under the severe conditions. On the contrary, the samples according to the present invention provided clear duplicated images free from background fog.

Further, each of these light-sensitive materials was subjected to the oil-desensitizing treatment to prepare an offset printing plate and printing was conducted. The light-sensitive materials according to the present invention provided 8,000 prints of clear image without background stains. However, with the sample of Comparative Example C-1, the above described edge mark of cuttings pasted up was not removed with the oil-desensitizing treatment and the background stains occurred from the start of printing, or the unevenness of duplicated image occurred on prints.

As can be seen from the above results, only the light-sensitive material according to the present invention can provide the excellent performance.

EXAMPLE 29

A mixture of 5 g of Resin (A-11), 35 g of Resin (B-21), 200 g of zinc oxide, 0.02 g of uranine, 0.04 g of Rose Bengal, 0.03 g of bromophenol blue, 0.40 g of phthalic anhydride and 300 g of toluene was dispersed by a homogenizer at $8\times10^3$ r.p.m. for 5 minutes, and then 0.006 g of diacetylacetone zirconium salt was added thereto, followed by dispersing at $1\times10^3$ r.p.m. for 1 minute.

The dispersion was coated on paper, which had been subjected to an electroconductive treatment, by a wire bar in a dry coverage of 26 g/m$^2$, dried for 10 seconds at 110° C. and then heated for 20 minutes at 140° C. Then, the coated material was allowed to stand for 24 hours under the condition of 20° C. and 65% RH to prepare an electrophotographic light-sensitive material.

As the result of the evaluation as described in Example 28, it can be seen that the light-sensitive material according to the present invention is excellent in charging properties, dark charge retention rate, and photosensitivity, and provides a clear duplicated image free from background fog and unevenness of image portion under severe conditions of high temperature and high humidity (30° C. and 80% RH) and low temperature and low humidity (15° C. and 30% RH). Further, when the material was employed as an offset master plate precursor, 10,000 prints of clear image quality were obtained.

EXAMPLES 30 TO 39

Each electrophotographic light-sensitive material was prepared in the same manner as described in Example 29, except for replacing 5 g Resin (A-11) with 5 g of each of Resins (A) shown in Table 6A below.

TABLE 6A

| Example No. | Resin (A) | Example No. | Resin (A) |
|---|---|---|---|
| 30 | A-1 | 35 | A-17 |
| 31 | A-2 | 36 | A-19 |
| 32 | A-4 | 37 | A-22 |
| 33 | A-7 | 38 | A-23 |
| 34 | A-13 | 39 | A-25 |

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example 29, more than 10,000 good prints were obtained respectively.

It can be seen from the results described above that each of the light-sensitive materials according to the present invention was satisfactory in all aspects of the surface smoothness of the photoconductive layer, electrostatic characteristics, and printing property.

EXAMPLES 40 TO 45

Each electrophotographic light-sensitive material was prepared in the same manner as described in Example 29, except for replacing 35 g of Resin (B-21) and 0.006 g of diacetylacetone zirconium salt with each of the compounds shown in Table 7A below.

TABLE 7A

| Example No. | Resin (B) | | Compound Added at After-Dispersing | |
|---|---|---|---|---|
| 40 | B-24 | 35 g | Propylene glycol | 0.2 g |
| | | | Tetra(n-butoxy) titanate | 0.001 g |
| 41 | B-28 | 35 g | Gluconic acid | 0.3 g |
| 42 | B-25 | 35 g | — | |

TABLE 7A-continued

| Example No. | Resin (B) | | Compound Added at After-Dispersing | |
|---|---|---|---|---|
| 43 | B-22 | 35 g | Simple substance of sulfur | 0.1 g |
| 44 | B-23 | 20 g | Di-n-butyl tin dilaurate | 0.001 g |
| | B-24 | 15 g | | |
| 45 | B-26 | 35 g | Trimellitic anhydride | 0.3 g |
| | | | Phenol | 0.002 g |

With each of the light-sensitive materials thus-prepared, image forming performance under the ambient condition of 20° C. and 65% RH, 30° C. and 80% RH or 15° C. and 30% RH, and printing property were evaluated in the same manner as described in Example 29.

Each of the light-sensitive materials according to the present invention was excellent in charging properties, dark charge retention rate, and photosensitivity, and provided a clear duplicated image free from background fog, unevenness of image portion and scratches of fine lines even when processed under severe conditions of high temperature and high humidity (30° C. and 80% RH) and low temperature and low humidity (15° C. and 30% RH). Further, when these materials were employed as offset master plate precursors, 10,000 prints of a clear image free from background stains were obtained respectively.

EXAMPLE 101

A mixture of 6 g (solid basis, hereinafter the same) of Resin (A-102), 34 g (solid basis, hereinafter the same) of Resin (B-24), 200 g of photoconductive zinc oxide, 0.018 g of Cyanine Dye (I) shown below, 0.15 g of salicylic acid and 300 g of toluene was dispersed by a homogenizer (manufactured by Nippon Seiki K.K.) at $6\times10^3$ r.p.m. for 10 minutes, and then 0.20 g of phthalic anhydride and 0.003 g of o-chlorophenol were added thereto, followed by dispersing at $1\times10^3$ r.p.m. for 1 minute to prepare a coating composition for a light-sensitive layer. The coating composition was coated on paper, which had been subjected to electrically conductive treatment, by a wire bar at a dry coverage of 22 g/m$^2$, followed by drying at 110° C. for 10 seconds and then heating at 140° C. for 30 minutes. The coated material was then allowed to stand in a dark place at 20° C. and 65% RH (relative humidity) for 24 hours to prepare an electrophotographic light-sensitive material.

Cyanine Dye (I)

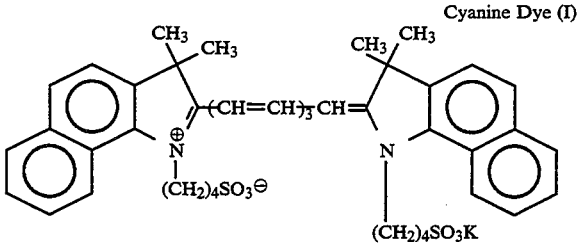

COMPARATIVE EXAMPLE A-101

An electrophotographic light-sensitive material was prepared in the same manner as in Example 101, except for using 6 g of Resin (R-1) shown below in place of 6 g of Resin (A-102).

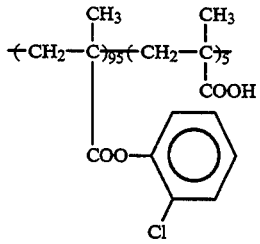

Resin (R-1)

Mw: 8 × $10^3$

COMPARATIVE EXAMPLE B-101

An electrophotographic light-sensitive material was prepared in the same manner as in Example 101, except for using 6 g of Resin (R-2) shown below in place of 6 g of Resin (A-102).

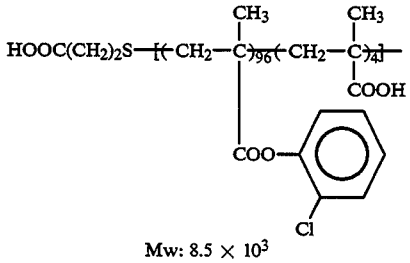

Resin (R-2)

Mw: 8.5 × $10^3$

With each of the light-sensitive material thus prepared, film property (surface smoothness),. image forming performance and printing property were evaluated.

The results obtained are shown in Table 101A below.

TABLE 101A

| | Example 101 | Comparative Example A-101 | Comparative Example B-101 |
|---|---|---|---|
| Smoothness of Photoconductive Layer (sec/cc) | 450 | 460 | 440 |
| Image Forming*2 Performance | | | |
| Condition I | Very good | Good | Good |
| Condition II | Good | Unevenness in half tone area | Unevenness in half tone area |
| Condition III | Good | Unevenness in half tone area | Unevenness in half tone area |
| Water Retentivity of Light-Sensitive Material*3 | No background stain | Slight background stain | Slight background stain |
| Printing Durability*4 | 8,000 | 4,000 | 6,000 |

The evaluation of each item shown in Table 101A was conducted in the following manner.

*1) Smoothness of Photoconductive Layer.

The smoothness (sec/cc) of the light-sensitive material was measured using a Beck's smoothness test machine (manufactured by Kumagaya Riko K.K.) under an air volume condition of 1 cc.

*2) Image Forming Performance

After the light-sensitive material was allowed to stand for one day under the ambient condition shown below, the light-sensitive material was charged to −6 kV and exposed to light emitted from a gallium-aluminum-arsenic semi-conductor laser (oscillation wavelength: 780 nm; output: 2.8 mW) at an exposure amount of 64 erg/$cm^2$ (on the surface of the photoconductive layer) at a pitch of 25 μm and a scanning speed of 300 m/sec. The thus formed electrostatic latent image was developed with a liquid developer ("ELP-T" produced by Fuji Photo Film Co., Ltd.), washed with a rinse solution of iso-paraffinic solvent ("Isopar G" manufactured by Esso Chemical K.K.) and fixed. The duplicated image obtained was visually evaluated for fog and image quality.

The ambient condition at the time of image formation was 20° C. and 65% RH (Condition I), 30° C. and 80% RH (Condition II) or 15° C. and 30% RH (Condition III).

*3) Water Retentivity of Light-Sensitive Material

A degree of hydrophilicity of the light-sensitive material after being subjected to an oil-desensitizing treatment for using as a printing plate was evaluated by processing under the following forced condition. Specifically, the light-sensitive material without subjecting to plate making was passed once through an etching machine using an aqueous solution obtained by diluting an oil-desensitizing solution ("ELP-EX" produced by Fuji Photo Film Co., Ltd.) to a five-fold volume with distilled water. The material thus-treated was mounted on a printing machine ("Hamada Star Type 8005X" manufactured by Hamada Star K.K.) and printing was conducted. The extent of background stain occurred on the 50th print was visually evaluated.

*4) Printing Durability

The light-sensitive material was subjected to plate making in the same manner as described in *2) above, passed once through an etching machine with ELP-EX. Printing was conducted using the plate thus-obtained and a number of prints on which background stain was first visually observed was determined.

As can be seen from the results shown in Table 101A above, the light-sensitive material according to the present invention provided duplicated images having very clear highly accurate image portions such as fine lines, fine letters and dots of continuous gradation and no background stain. Further, it provided stably clear duplicated images even under the severe ambient condition such as a low temperature and low humidity condition or a high temperature and high humidity condition at the time of image formation.

On the contrary, although the light-sensitive materials of Comparative Examples A-101 and B-101 provided good duplicated images under the ambient condition of normal temperature and normal humidity (Condition I), the occurrence of unevenness of density was observed in the highly accurate image portions, in particular, half tone areas of continuous gradation upon the fluctuation of ambient condition at the time of image formation.

When each of the light-sensitive materials was subjected to the oil-desensitizing treatment under the forced condition of using a solution of a reduced oil-desensitizing power, followed by practical printing, and the extent of adhesion of ink on prints was evaluated as described in *3), the adhesion of ink was observed in cases of using the light-sensitive material of Comparative Examples A-101 and B-101, although no adhesion of ink occurred according to the present invention.

As a result of conducting plate making, oil-desensitizing treatment under an usual condition and printing as described in *4), the light-sensitive material according to the present invention provided 8,000 prints of faithfully duplicated images without the occurrence of background stain. On the contrary, with the light-sensitive materials of Comparative Examples A-101 and B-101, only 4,000 prints and 6,000 prints could be obtained, respectively. Further, when the plate making was conducted under the severe condition of Condition II or Condition III, poor images on prints were obtained from the start of printing due to poor reproducibility of duplicated images.

From these results it is believed that the resin (A) according to the present invention suitably interacts with zinc oxide to form the condition under which an oil-desensitizing reaction proceeds easily and sufficiently with an oil-desensitizing solution and that the remarkable improvement in film strength is achieved by the action of the resin (B).

EXAMPLE 102

A mixture of 6 g of Resin (A-115), 34 g of Resin (B-2), 200 g of photoconductive zinc oxide, 0,020 g of Methine Dye (II) shown below, 0.20 g of N-hydroxymalinimide and 300 g of toluene was treated in the same manner as described in Example 101 to prepare an electrophotographic light-sensitive material.

Methine Dye (II)

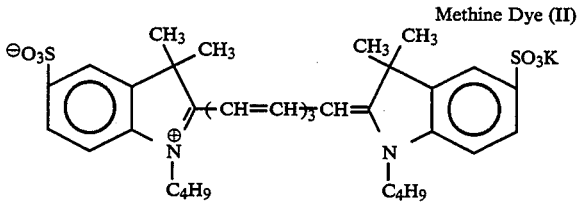

With the light-sensitive material thus-prepared, a film property in terms of surface smoothness, electrostatic characteristics, and image forming performance was evaluated. Further, printing property was evaluated when it was used as an electrophotographic lithographic printing plate precursor.

The results obtained are shown in Table 102A below.

TABLE 102A

| | | |
|---|---|---|
| Smoothness of Photoconductive Layer (sec/cc) | | 440 |
| Electrostatic characteristics*5) | | |
| $V_{10}$ (-V) | Condition I | 750 |
| | Condition II | 730 |
| | Condition III | 745 |
| D.R.R. (%) | Condition I | 85 |
| | Condition II | 80 |
| | Condition III | 83 |
| $E_{1/10}$ (erg/cm$^2$) | Condition I | 20 |
| | Condition II | 19 |
| | Condition III | 28 |
| $E_{1/100}$ (erg/cm$^2$) | Condition I | 31 |
| | Condition II | 35 |
| | Condition III | 43 |
| Image Forming Performance | | |
| | Condition I | Very good |
| | Condition II | Good |
| | Condition III | Good |
| Water Retentivity of Light-Sensitive Material | | Good |
| Printing Durability | | 8,000 |

The evaluation of the electrostatic characteristics was conducted in the following manner.

*5) Electrostatic Characteristics

The light-sensitive material was charged with a corona discharge to a voltage of −6 kV for 20 seconds in a dark room at 20° C. and 65% RH using a paper analyzer ("Paper Analyzer SP-428" manufactured by Kawaguchi Denki K.K.). Ten seconds after the corona discharge, the surface potential $V_{10}$ was measured. The sample was allowed to stand in the dark for an additional 120 seconds, and the potential $V_{130}$ was measured. The dark decay retention rate (DRR; %), i.e., percent retention of potential after dark decay for 120 seconds, was calculated from the following equation:

$$DRR\ (\%) = (V_{130}/V_{10}) \times 100$$

Separately, the surface of photoconductive layer was charged to −500V with a corona discharge and then exposed to monochromatic light having a wavelength of 780 nm, and the time required for decay of the surface potential $V_{10}$ to one-tenth was measured to obtain an exposure amount $E_{1/10}$ (erg/cm$^2$).

Further, the light-sensitive material was charged to −500V with a corona discharge in the same manner as described for the measurement of $E_{1/10}$, then exposed to monochromatic light having a wavelength of 780 nm, and the time required for decay of the surface potential $V_{10}$ to one-hundredth was measured to obtain an exposure amount $E_{1/100}$ (erg/cm$^2$).

The measurements were conducted under ambient condition of 20° C. and 65% RH (Condition I), 30° C. and 80% RH (Condition II) or 15° C. and 30% RH (Condition III).

As is apparent from the results shown in Table 102A above, the light-sensitive material according to the present invention had good surface smoothness which indicated a uniform dispersion state of zinc oxide. The electrostatic characteristics were stable and good even when the ambient condition was fluctuated. With the images forming performance, duplicated images faithful to the original were obtained without the formation of background stain. Further, when it was used as an offset master plate precursor and subjected to the oil-desensitizing treatment and printing, 8,000 prints of good quality were obtained.

EXAMPLES 103 TO 122

Each electrophotographic light-sensitive material was prepared in the same manner as described in Example 102, except for replacing Resin (A-115) and Resin (B-2) with each of Resins (A) and (B) shown in Table 103A below, respectively.

The electrostatic characteristics of the resulting light-sensitive materials were evaluated in the same manner as described in Example 102.

TABLE 103A

| Example No. | Resin (A) | Resin (B) | Example No. | Resin (A) | Resin (B) |
|---|---|---|---|---|---|
| 103 | A-103 | B-3 | 113 | A-115 | B-13 |
| 104 | A-104 | B-4 | 114 | A-116 | B-15 |
| 105 | A-105 | B-1 | 115 | A-117 | B-16 |
| 106 | A-106 | B-5 | 116 | A-121 | B-17 |

TABLE 103A-continued

| Example No. | Resin (A) | Resin (B) | Example No. | Resin (A) | Resin (B) |
|---|---|---|---|---|---|
| 107 | A-107 | B-6 | 117 | A-119 | B-18 |
| 108 | A-108 | B-7 | 118 | A-129 | B-19 |
| 109 | A-109 | B-8 | 119 | A-131 | B-20 |
| 110 | A-111 | B-9 | 120 | A-123 | B-25 |
| 111 | A-112 | B-11 | 121 | A-120 | B-8 |
| 112 | A-114 | B-12 | 122 | A-113 | B-12 |

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example 102, more than 8,000 good prints were obtained respectively.

It can be seen from the results described above that each of the light-sensitive materials according to the present invention was satisfactory in all aspects of the surface smoothness of the photoconductive layer, electrostatic characteristics, and printing property.

EXAMPLES 123 TO 126

Each electrophotographic light-sensitive material was prepared in the same manner as described in Example 101, except for replacing Cyanine Dye (I) with each of the dye shown in Table 104A below.

TABLE 104A

| Example No. | | Dye |
|---|---|---|
| 123 | (III) | 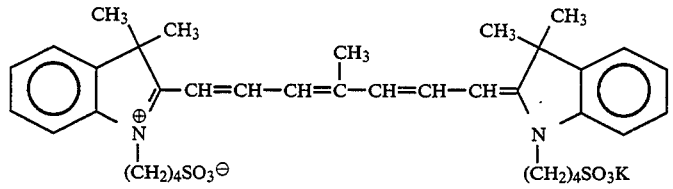 |
| 124 | (IV) | 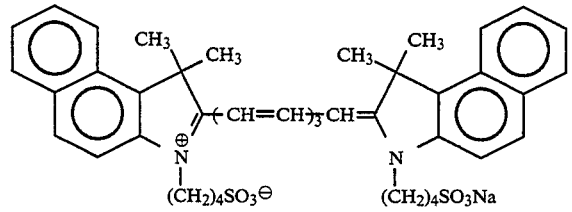 |
| 125 | (V) | 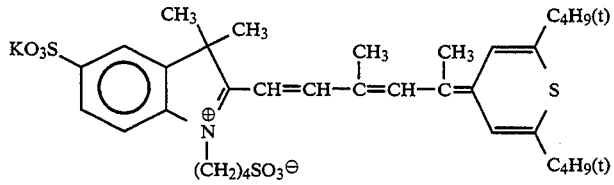 |
| 126 | (VI) | 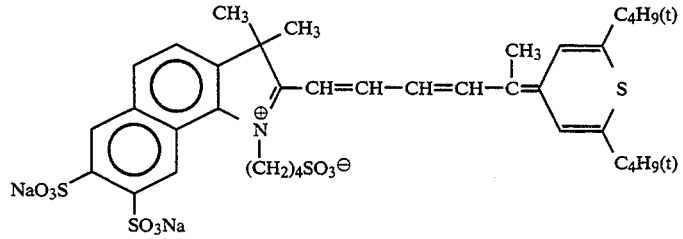 |

Each of the light-sensitive materials according to the present invention was excellent in charging properties, dark charge retention rate, and photosensitivity, and provided clear duplicated images free from background fog even when processed under severe conditions of high temperature and high humidity (30° C. and 80% RH) and low temperature and low humidity (15° C. and 30% RH).

EXAMPLES 127 AND 128

A mixture of 6 g of Resin (A-126) and 34 g of Resin (B-8) (Example 127) or Resin (A-111) and 34 g Resin (B-13) (Example 128), 200 g of zinc oxide, 0.02 g of uranine, 0.03 g of Methine Dye (VII) shown below, 0.03 g of Methine Dye (VIII) shown below, 0.18 g of p-hydroxybenzoic acid and 300 g of toluene was dispersed by a homogenizer at $7\times10^3$ r.p.m. for 5 minutes to prepare a coating composition for a light-sensitive layer. The coating composition was coated on paper, which had been subjected to electrically conductive treatment, by a wire bar at a dry coverage of 18 g/m$^2$, and dried for 20 seconds at 110° C. Then, the coated material was allowed to stand in a dark place for 24 hours under the conditions of 20° C. and 65% RH to prepare each electrophotographic light-sensitive material.

Methine Dye (VII)

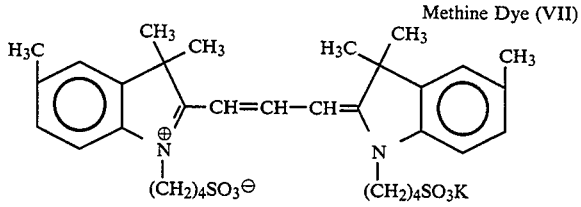

Methine Dye (VIII)

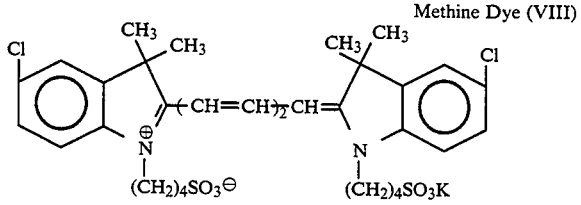

subjected to plate making by a full-automatic plate making machine (ELP-404V manufactured by Fuji Photo Film Co., Ltd.) using ELP-T as a toner. The duplicated image thus obtained was visually evaluated for fog and image quality. The ambient condition at the time of image formation was 20° C. and 65% RH (Condition I), 30° C. and 80% RH (Condition II) or 15° C. and 30% RH (Condition III). The original used for the duplication was composed of cuttings of other originals pasted up thereon.

The results obtained are shown in Table 105A below.

TABLE 105A

| | | Example 127 | Example 128 | Comparative Example C-101 |
|---|---|---|---|---|
| Binder Resin | | (A-126)/(B-8) | (A-111)/(B-13) | (R-1)/(B-13) |
| Smoothness of Photoconductive Layer (sec/cc) | | 460 | 480 | 455 |
| Electrostatic Characteristics*6) | | | | |
| $V_{10}$ (-V) | Condition I | 585 | 710 | 730 |
| | Condition II | 570 | 695 | 700 |
| | Condition III | 580 | 700 | 720 |
| D.R.R. (%) | Condition I | 87 | 96 | 94 |
| | Condition II | 83 | 91 | 86 |
| | Condition III | 88 | 95 | 95 |
| $E_{1/10}$ (lux/sec) | Condition I | 10.8 | 9.4 | 9.4 |
| | Condition II | 11.1 | 10.1 | 10.0 |
| | Condition III | 12.0 | 11.1 | 10.8 |
| $E_{1/100}$ (lux/sec) | Condition I | 16 | 14 | 15 |
| | Condition II | 18 | 15 | 14 |
| | Condition III | 20 | 18 | 17 |
| Image-Forming*7) Performance | Condition I | Good | Very Good | Good |
| | Condition II | Good | Very Good | Edge mark of cutting, Unevenness in half tone area |
| | Condition III | Good | Very Good | Unevenness of white spots in image portion |
| Water Retentivity of Light-Sensitive Material | | Good | Very Good | Good |
| Printing Durability | | 8,000 | 8,000 | 5,000 |

COMPARATIVE EXAMPLE C-101

An electrophotographic light-sensitive material was prepared in the same manner as in Example 128, except for replacing 6 g of Resin (A-111) with 6 g of Resin (R-1) described above.

With each of the light-sensitive materials thus prepared, various characteristics were evaluated in the same manner as in Example 102, except that some electrostatic characteristics and image forming performance were evaluated according to the following test methods.

*6) Electrostatic Characteristics: $E_{1/10}$ and $E_{1/100}$

The surface of the photoconductive layer was charged to −400V with corona discharge, and then irradiated by visible light of the illuminance of 2.0 lux. Then, the time required for decay of the surface potential ($V_{10}$) to 1/10 or 1/100 thereof was determined, and the exposure amount E1/10 or $E_{1/100}$ (lux.sec) was calculated therefrom.

*7) Image Forming Performance

The electrophotographic light-sensitive material was allowed to stand for one day under the ambient condition described below, the light-sensitive material was From the results shown in Table 105A above, it can be seen that each light-sensitive material exhibits good properties with respect to the surface smoothness of the photoconductive layer and electrostatic characteristics.

With respect to image-forming performance, the edge mark of cuttings pasted up was observed as background fog in the non-image areas or the occurrence of unevenness of white spots in the image portion was observed in the sample of Comparative Example C-101 under the severe conditions. On the contrary, the samples according to the present invention provided clear duplicated images free from background fog.

Further, each of these light-sensitive materials was subjected to the oil-desensitizing treatment to prepare an offset printing plate and printing was conducted. The light-sensitive materials according to the present invention provided 8,000 prints of clear image without background stains. However, with the sample of Comparative Example C-101, the above described edge mark of cuttings pasted up was not removed with the oil-desensitizing treatment and the background stains occurred from the start of printing, or the unevenness of duplicated image occurred on prints.

As can be seen from the above results, only the light-sensitive material according to the present invention can provide the excellent performance.

EXAMPLE 129

A mixture of 5 g of Resin (A-117), 35 g of Resin (B-21), 200 g of zinc oxide, 0.02 g of uranine, 0.04 g of Rose Bengal, 0.03 g of bromophenol blue, 0.40 g of phthalic anhydride and 300 g of toluene was dispersed by a homogenizer at $8\times10^3$ r.p.m. for 5 minutes, and then 0.006 g of diacetylacetone zirconium salt was added thereto, followed by dispersing at $1\times10^3$ r.p.m. for 1 minute.

The dispersion was coated on paper, which had been subjected to an electroconductive treatment, by a wire bar in a dry coverage of 26 g/m$^2$, dried for 10 seconds at 110° C. and then heated for 20 minutes at 140° C. Then, the coated material was allowed to stand for 24 hours under the condition of 20° C. and 65% RH to prepare an electrophotographic light-sensitive material.

As the result of the evaluation as described in Example 128, it can be seen that the light-sensitive material according to the present invention is excellent in charging properties, dark charge retention rate, and photosensitivity, and provides a clear duplicated image free from background fog and unevenness of image portion under severe conditions of high temperature and high humidity (30° C. and 80% RH) and low temperature and low humidity (15° C. and 30% RH). Further, when the material was employed as an offset master plate precursor, 10,000 prints of clear image quality were obtained.

EXAMPLES 130 TO 139

Each electrophotographic light-sensitive material was prepared in the same manner as described in Example 129, except for replacing 5 g Resin (A-117) with 5 g of each of Resins (A) shown in Table 106A below.

TABLE 106A

| Example No. | Resin (A) | Example No. | Resin (A) |
|---|---|---|---|
| 130 | A-103 | 135 | A-126 |
| 131 | A-105 | 136 | A-128 |
| 132 | A-106 | 137 | A-129 |
| 133 | A-107 | 138 | A-130 |
| 134 | A-119 | 139 | A-131 |

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example 129, more than 10,000 good prints were obtained respectively.

It can be seen from the results described above that each of the light-sensitive materials according to the present invention was satisfactory in all aspects of the surface smoothness of the photoconductive layer, electrostatic characteristics, and printing property.

EXAMPLES 140 TO 145

Each electrophotographic light-sensitive material was prepared in the same manner as described in Example 129, except for replacing 35 g of Resin (B-21) and 0.006 g of diacetylacetone zirconium salt with each of the compounds shown in Table 107A below.

TABLE 107A

| Example No. | Resin (B) | | Compound Added at After-Dispersing | |
|---|---|---|---|---|
| 140 | B-24 | 35 g | Propylene glycol | 0.2 g |
| | | | Tetra(n-butoxy) titanate | 0.001 g |
| 141 | B-28 | 35 g | Gluconic acid | 0.3 g |
| 142 | B-25 | 35 g | — | |
| 143 | B-22 | 35 g | Simple substance of sulfur | 0.1 g |
| 144 | B-23 | 20 g | Di-n-butyl tin dilaurate | 0.001 g |
| | B-24 | 15 g | | |
| 145 | B-26 | 35 g | Trimellitic anhydride | 0.3 g |
| | | | Phenol | 0.002 g |

With each of the light-sensitive materials thus-prepared, image forming performance under the ambient condition of 20° C. and 65% RH, 30° C. and 80% RH or 15° C. and 30% RH, and printing property were evaluated in the same manner as described in Example 128.

Each of the light-sensitive materials according to the present invention was excellent in charging properties, dark charge retention rate, and photosensitivity, and provided a clear duplicated image free from background fog, unevenness of image portion and scratches of fine lines even when processed under severe conditions of high temperature and high humidity (30° C. and 80% RH) and low temperature and low humidity (15° C. and 30% RH). Further, when these materials were employed as offset master plate precursors, 10,000 prints of a clear image free from background stains were obtained respectively.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material, comprising a support having provided thereon at least one photoconductive layer containing an inorganic photoconductive substance, a spectral sensitizing dye and a binder resin, wherein the binder resin comprises at least one resin (A) shown below and at least one resin (B) shown below;

Resin (A)

A starlike copolymer having a weight average molecular weight of from $1\times10^3$ to $2\times10^4$ and comprising an organic molecule having bonded thereto at least three polymer chains each containing a polymer component (a) corresponding to a repeating unit represented by the following formula (I):

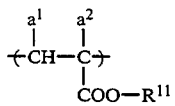

(I)

wherein $a^1$ and $a^2$ each represents a hydrogen atom, a halogen atom, a cyano group or a hydrocarbon group, and $R^{11}$ represents a hydrocarbon group; and a polymer component (b) containing at least one polar group selected from the group consisting of $—PO_3H_2$, $—SO_3H$, —COOH,

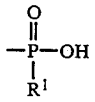

and a cyclic acid anhydride-containing group, wherein $R^1$ represents a hydrocarbon group or $—OR^2$ where $R^2$ represents a hydrocarbon group, and wherein polymer component (a) is present in an amount of at least 30% by weight and component (b) is present in an amount from 1 to 20% by weight, Resin (B)

A resin having a weight average molecular weight of from $3\times10^4$ to $1\times10^6$ and containing at least 30% by weight of a polymer component corresponding to a repeating unit represented by the following formula (III):

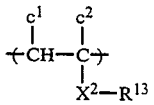

(III)

wherein $c^1$ and $c^2$ each represents a hydrogen atom, a halogen atom, a cyano group or a hydrocarbon group; $X^2$ represents $—(CH_2)_rCOO—$, $—(CH_2)_rOCO—$, —O—or —CO—, wherein r represents an integer of from 0 to 3; and $R^{13}$ represents a hydrocarbon group.

2. An electrophotographic light-sensitive material as claimed in claim 1, wherein the copolymer component represented by the formula (I) is a copolymer component represented by the following formula (Ia) or (Ib):

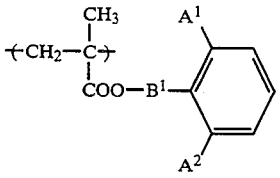

(Ia)

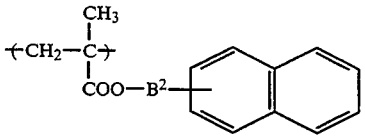

(Ib)

wherein $A^1$ and $A^2$ each represents a hydrogen atom, a hydrocarbon group having from 1 to 10 carbon atoms, a chlorine atom, a bromine atom, $—COR^{14}$ or $—COOR^{14}$, wherein $R^{14}$ represents a hydrocarbon group having from 1 to 10 carbon atoms; and $B^1$ and $B^2$ each represents a bond or a linking group containing from 1 to 4 linking atoms, which connects —COO—and a benzene ring.

3. An electrophotographic light-sensitive material as claimed in claim 2, wherein the linking group containing from 1 to 4 linking atoms represented by $B^1$ or $B^2$ is $—(CH_2)_a$, $—CH_2OCO—$, $—CH_2CH_2OCO—$, $—(CH_2O)_b—$, or $—CH_2CH_2O—$, wherein a represents an integer of 1, 2 or 3 and b represents an integer of 1 or 2.

4. An electrophotographic light-sensitive material as claimed in claim 1, wherein the organic molecule has up to 15 polymer chains bonded thereto.

5. An electrophotographic light-sensitive material as claimed in claim 1, wherein the copolymer component represented by the formula (I) in polymer chain is present in an amount from 30 to 99 parts by weight per 100 parts by weight of the resin (A).

6. An electrophotographic light-sensitive material as claimed in claim 1, wherein the resin (A) further contains a polymer component represented by the following general formula (II):

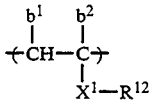

(II)

wherein $X^1$ represents —COO—, —OCO—, $—(CH_2)_p—OCO—$,

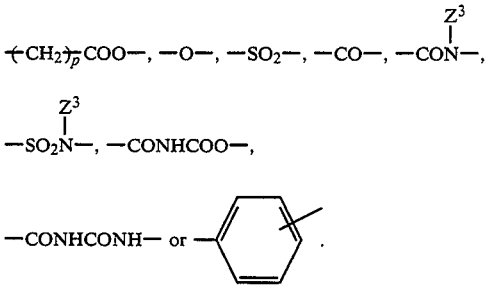

wherein p represents an integer of from 1 to 3, $Z^3$ represents a hydrogen atoms or a hydrocarbon group, $R^{12}$ represents a hydrocarbon group, and $b^1$ and $b^2$, which may be the same or different, each has the same meaning as $a^1$ or $a^2$ in the general formula (I).

7. An electrophotographic light-sensitive material as claimed in claim 1, wherein the polymer chains are AB block polymer chains each containing an A block comprising at least one polymer component (a) and a B block comprising at least one polymer component (b).

8. An electrophotographic light-sensitive material as claimed in claim 1, wherein the resin (B) has at least one polar group located at one terminal of the polymer main chain and selected from the group consisting of $—PO_3H_2$, $—SO_3H$, —COOH, and a cyclic acid anhydride-containing group, wherein $R^3$ has the same meaning as $R^1$ described above.

9. An electrophotographic light-sensitive material as claimed in claim 1, wherein the resin (B) further contains a polymer component having a heat-and/or photocurable functional group.

10. An electrophotographic light-sensitive material as claimed in claim 1, wherein resin (A) and resin (B) are present in a weight ratio of resin (A)/resin (B) of 0.05/0.95 to 0.80/0.20.

11. An electrophotographic light-sensitive material as claimed in claim 1, wherein the organic molecule having bonded thereto at least three polymer chains has a molecular weight of 1,000 or less.

12. An electrophotographic light-sensitive material as claimed in claim 1, wherein the organic molecule has up to 10 polymer chains bonded thereto.

* * * * *